US009289051B1

(12) United States Patent
Capps

(10) Patent No.: US 9,289,051 B1
(45) Date of Patent: Mar. 22, 2016

(54) TRAUMA UTILITY BELT

(71) Applicant: Rebecca Anne Capps, Bay St. Louis, MS (US)

(72) Inventor: Rebecca Anne Capps, Bay St. Louis, MS (US)

( * ) Notice: Subject to any disclaimer, the term of this patent is extended or adjusted under 35 U.S.C. 154(b) by 0 days.

(21) Appl. No.: 14/478,995

(22) Filed: Sep. 5, 2014

(51) Int. Cl.

| | |
|---|---|
| ***A45C 1/04*** | (2006.01) |
| ***A45F 3/00*** | (2006.01) |
| ***A45F 5/02*** | (2006.01) |
| ***A41F 9/00*** | (2006.01) |
| ***A45F 5/00*** | (2006.01) |
| ***A45F 3/04*** | (2006.01) |

(52) U.S. Cl.
CPC . *A45F 5/02* (2013.01); *A41F 9/002* (2013.01); *A45F 3/00* (2013.01); *A45F 3/005* (2013.01); *A45F 3/04* (2013.01); *A45F 5/00* (2013.01); *A45F 5/021* (2013.01)

(58) Field of Classification Search
CPC ..... A45F 2003/127; A45F 3/005; A45F 5/02; A45F 3/04; A45F 5/021; A45F 5/00; A45F 3/00; A41F 9/002
USPC ..... 224/660, 662, 681, 904; 2/312
See application file for complete search history.

(56) References Cited

U.S. PATENT DOCUMENTS 1,478,497 A * 12/1923 Welch ..... A01K 97/06 224/5
1,600,027 A * 9/1926 Welsand ..... A62B 35/00 182/3
4,907,729 A * 3/1990 Hess, III ..... A45C 1/04 224/240
5,024,361 A * 6/1991 Flowers ..... 224/223
5,158,510 A * 10/1992 Lemire ..... 482/51
D333,729 S 3/1993 Hopp
5,201,448 A 4/1993 Schue
D345,861 S 4/1994 Knox
5,316,022 A * 5/1994 Schiek, Sr. ..... A61F 5/028 128/876
5,511,703 A * 4/1996 Ryerson ..... A41F 9/002 224/664

(Continued)

FOREIGN PATENT DOCUMENTS

DE 102011114244 A1 * 3/2013 ..... A41D 1/00

OTHER PUBLICATIONS

Summay of NIOSH Back Belt Studies, Ergonomics and Musculoskeletal Disorders, http://www.cdc.gov/niosh/topics/ergonomics/beltssumm.html, dowloaded Aug. 26, 2014 12:11 PM.

(Continued)

*Primary Examiner* — Justin Larson
*Assistant Examiner* — Lester L Vanterpool
(74) *Attorney, Agent, or Firm* — William C. West

(57) ABSTRACT

The present invention is a trauma utility device that includes an elongated belt having a plurality of compartments and devices for carrying and storing necessary equipment, a wide mid portion adjacent to the wearer's back with a high density foam pad for back support, and a scalloped upper edge at the wearer's hips, enhancing an individual's ability to freely turn and move while wearing the belt. The plurality of compartments and devices may include: a personal items pouch, a stethoscope chest piece holder, a stethoscope ear tube retainer, a communication compartment, a pen holder, and a trauma shears holster. The compartments and devices may be positioned on each side of the back mid portion around the longitudinal axis of the belt. Additionally, the belt and associated compartments and devices have an antimicrobial capability to help destroy and inhibit the growth of microorganisms and especially pathogenic microorganisms.

7 Claims, 32 Drawing Sheets

(56) References Cited

U.S. PATENT DOCUMENTS 5,577,653 A 11/1996 Bieker
5,586,969 A * 12/1996 Yewer, Jr. ..... A61F 5/028 128/101.1
5,683,022 A * 11/1997 Evans ..... A41F 9/002 224/583
5,693,006 A * 12/1997 Slautterback ..... A61F 5/028 2/48
5,941,438 A * 8/1999 Price ..... A41F 9/002 224/660
6,015,073 A * 1/2000 Wojciak et al. ..... A41F 9/002 2/312
6,053,883 A * 4/2000 Schiek, Sr. ..... A61F 5/028 602/19
D425,353 S 5/2000 Foy
6,213,365 B1 * 4/2001 Stocke ..... A41D 13/0012 224/223
D445,185 S 7/2001 Najmi
6,264,081 B1 * 7/2001 Wojciak ..... A41F 9/002 2/312
6,390,348 B1 * 5/2002 Godshaw ..... A45F 5/00 224/660
6,526,968 B1 * 3/2003 Izuchukwu et al. ..... F17C 1/00 128/202.19
6,698,632 B1 * 3/2004 Turner, Jr. ..... A45F 5/021 224/196
6,712,251 B2 * 3/2004 Godshaw ..... A45C 7/0086 224/260
6,899,257 B2 5/2005 Jones
6,913,176 B1 * 7/2005 Buscemi ..... A45F 5/00 224/665
D554,268 S * 10/2007 Harding ..... D24/190
7,364,558 B2 * 4/2008 Weaver, II ..... A61F 5/028 297/230.1
2003/0131398 A1 * 7/2003 Haines ..... 2/312
2006/0124487 A1 * 6/2006 Brown ..... B43K 23/001 206/371
2006/0206992 A1 * 9/2006 Godshaw ..... A61F 5/028 2/338
2007/0095873 A1 * 5/2007 Petzl et al. ..... A62B 35/0025 224/660
2007/0205235 A1 * 9/2007 Knight ..... A45F 5/00 224/223
2009/0039129 A1 * 2/2009 Peterson-Malesci ... A45F 5/021 224/682

OTHER PUBLICATIONS

Low Back Pain Fact Sheet, national Institute of Neurological Disorders and Stroke,http://www.ninds.nih.gov/disorders/backpain/detail_backpain.htm., downloaded Aug. 27, 2014 3:12P.

* cited by examiner

TRAUMA UTILITY BELT

TECHNICAL FIELD OF THE INVENTION

The present invention relates generally to utility belts for medical personnel with compartments and other devices for carrying necessary equipment, and more particularly to a belt for trauma personnel having functional back support and having an antimicrobial capability.

BACKGROUND OF THE INVENTION

Utility belts with back support are often used by construction workers and personal lifting heavy items. Exemplary of such devices are U.S. Pat. Nos. 5,201,448, and 6,053,883. These prior art devices provide a belt that is often uncomfortable to wear and do not provide specialized compartments to carry medical equipment or have an antimicrobial capability. Some utility belts have been designed for heath care providers. Exemplary of such devices are U.S. Pat. Nos. 5,024,361, 5,577,653, Des 333,729, Des 345,861, D425,353S, D445, 185S, Des 333,729, and US Published Application Nos. 2003/0131398 and 2007/0205235. These prior art devices do not have an antimicrobial capability or provide for back support. Additionally, they do not include the capability to carry many of the necessary items of specialized equipment that must be readily available for trauma care specialist when rendering medical care to patents.

Low back pain often interferes with work, routine daily activities, or recreation and is a common cause of job-related disability and leading a contributor to missed work. Elastic back belts have been found to reduce the distance of forward spine bending and the velocities of forward-and-backward spine bending. Medical workers often spend long hours on their feet and traumatize their backs resulting in pain and discomfort. The implementation of back-support policies have been shown to reduce the employee rate of acute low back injuries and a good back support policy may be augmented with more effective equipment. Additionally, medical personnel, especially trauma specialist, require that certain medical and communications equipment readily be available to render timely medical service, and it is important to utilize equipment that reduces the likelihood of transmitting dangerous diseases.

It is therefore a general object of the present invention to provide an improved utility belt for medical personnel, especially trauma care specialist, which provides back support and provides for the ability to carry and store necessary equipment. Compartments and holding devices for trauma shears, communications equipment, pens, personal items, a stethoscope bell and a stethoscope's ear tubes may be positioned around the belt apart from a mid portion of the belt that is adjacent to the wearer's back, and a plurality of fasteners may be attached along the belt to secure critical equipment. A further object of the present invention is to not only provide a utility belt with back support but to provide a utility belt with the capability to provide broad back support as the belt stretches around the circumference of the waist which will be identified as the belt longitudinal axial direction and a utility belt that retains limited movement of the belt in the direction perpendicular to the axial direction. A foam pad in the mid portion of the belt provides additional support for the lower lumbar region of the wearer's back. Yet another object of the invention is to provide a trauma utility belt made of materials that will reduce the likelihood of transmitting diseases. The belt and all associated components may be made of materials having an antimicrobial capability to help destroy and inhibit the growth of microorganisms and especially pathogenic microorganisms. These and other objects will be apparent to those skilled in the art.

SUMMARY OF THE INVENTION

The trauma utility belt of the present invention includes an elongated belt having a wide mid portion tapering to narrower first and second hip portions and the first and second hip portions tapering to wider first and second end portions, respectively. A first end fastener is mounted on the first end of the belt and is connectable to a second end fastener located on the second end of the belt. The mid portion of the belt is positioned against the wearer's back and has a thickness and width so as to provide abdominal and lower back support when the belt is tightened around the lower abdomen of a person. The belt is comprised of an inner layer of material and an outer layer of material with a pad positioned between the inner and outer layers of the belt. The pad preferably made of high density foam is held in position by a row of stitches around the pad perimeter. The pad provides additional support to the lower lumbar of the wearer. The upper edge of the belt tapers down from the mid portion to the middle of the first hip and the middle of the second hip portions, and tapers up from the middle of the first hip portion to the first end portion, and tapered up from the second hip portions to the second end portion, providing for a scalloped upper edge at the hips of the wearer. A personal items pouch, a stethoscope chest piece holder, a stethoscope ear tube retainer, a communication compartment, a pen holder, and a trauma shears holster may be positioned around the belt apart from the belt mid portion. Additionally, a plurality of equipment attaching devices, such as a snap hook, may be attached directly to the belt and to the various compartments, devices, and holders positioned around the belt.

DESCRIPTION OF THE PREFERRED EMBODIMENT

Figure 1:
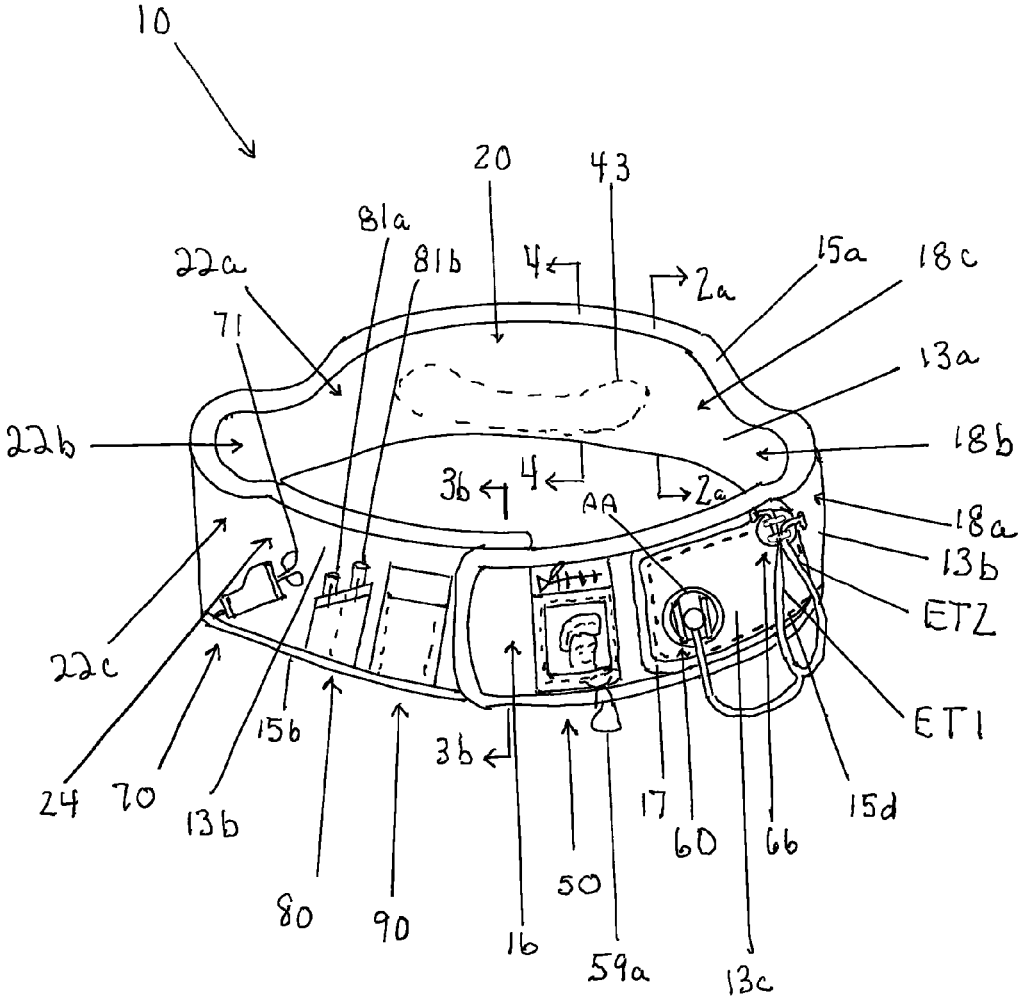
FIG. 1 is a pictorial view of the trauma utility belt

Referring now to the drawings, in which similar or corresponding parts are identified with the same reference numeral, and more particularly looking to FIG. 1, the present invention is a trauma utility belt designated generally at 10. Looking at FIG. 2*a*, a cross section view along line 2*a*-2*a* in FIG. 1, the belt 10 comprises an inner layer 12 and an outer layer 14 having the same length and width fastened by stitches resulting in an exposed surface 13*a* of the inner layer 12 and an exposed surface 13*b* of the outer layer 14 of the belt 10. A piping 33*a* is applied over the peripheral edges of inner layer 12 and outer layer 14 forming a convex upper edge 15*a*, and a convex lower edge 15*b*. Referring again FIG. 1, the belt 10 lies in 9 distinct portions: a first end portion 16, a first taper portion 18*a*, a first hip portion 18*b*, a second taper portion 18*c*, a mid portion 20, a third taper portion 22*a*, a second hip portion 22*b*, a fourth taper portion 22*c*, and a second end portion 24. The belt 10 has a longitudinal axis running from the first end portion 16 to the second end portion 24 that symmetrically divides the first end portion 16, the mid portion 20, and the second end portion 24. An accessory layer 17 with an exposed surface 13*c* is attached to the exposed surface 13*b* of the outer layer 14 of the first end portion 16 by an accessory row of stitches 15*d* inside the perimeter of the exposed surface 13*c*. The accessory layer 17 is positioned between the upper edge 15*a* and the lower edge 15*b* and generally runs from the first taper portion 18*a* a distance of ⅓ to ⅔, preferably ½, the length of the first end portion 16 as measured along the longitudinal axis of the belt 10.

Figure 2A:
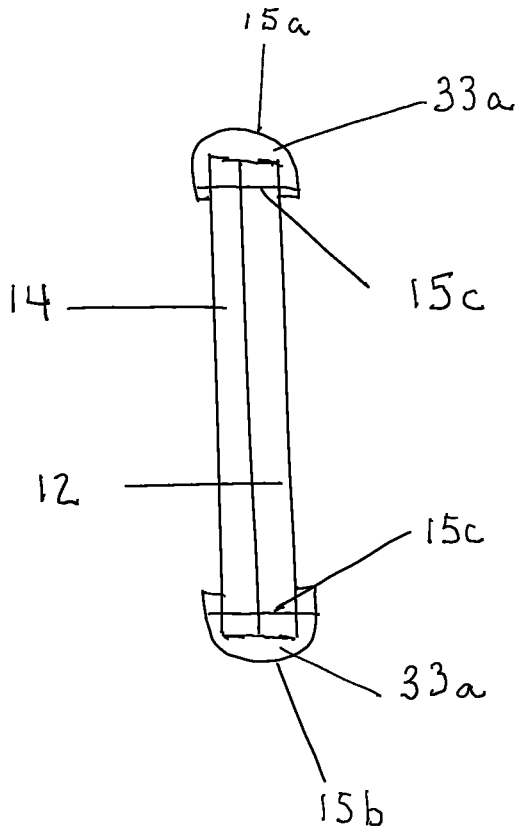
FIG. 2*a* is a cross sectional view taken along line 2*a*-2*a* for FIG. 1 showing an inner and outer layer with piping applied
Figure 2B:
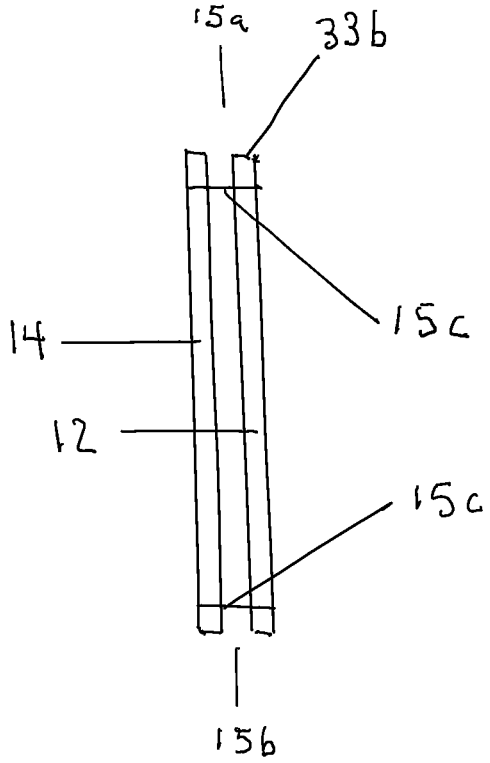
FIG. 2*b* is a view of the peripheral edges cut to shape
Figure 2C:
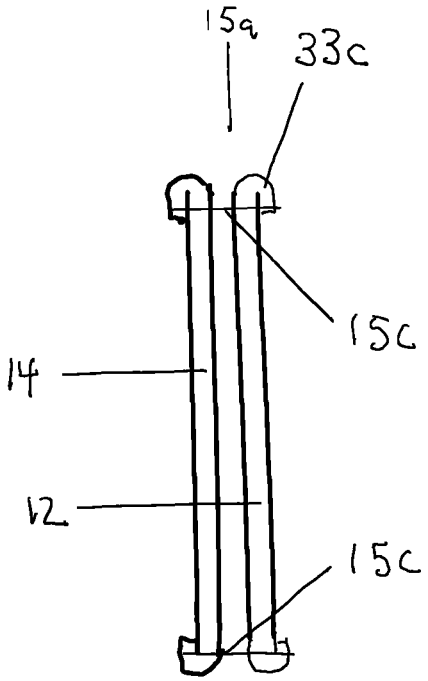
FIG. 2*c* is a view of the peripheral edges folded outward
Figure 2D:
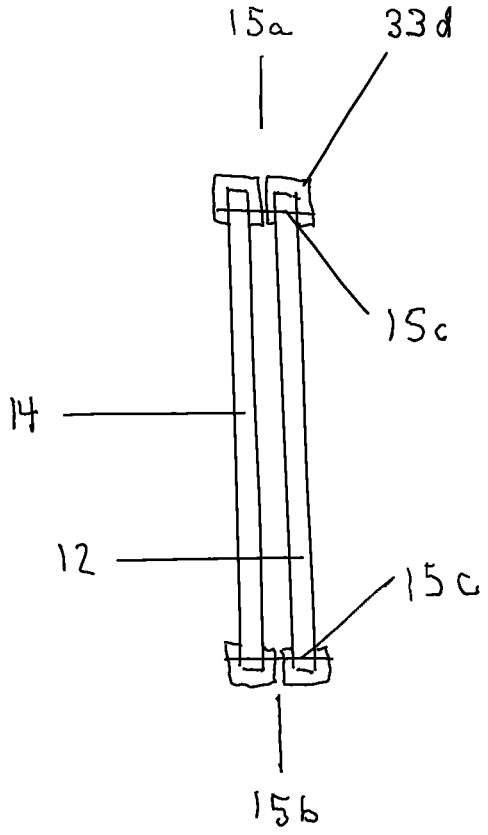
FIG. 2*d* is a view of piping over a single layer
Figure 2E:
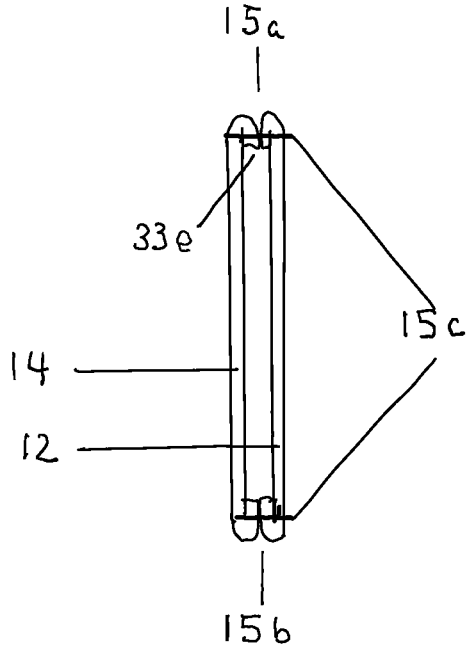
FIG. 2*e* is a view of the peripheral edges folded inward

Although a double layer piping 33*a* may be applied to the peripheral edges of belt as shown in FIG. 2*a*, the peripheral edges of the inner layer 12 and the outer layer 14 may be cut to shape 33*b* as shown in FIG. 2*b*, folded outward 33*c* as shown in FIG. 2*c*, a single layer piping 33*d* applied to the inner layer 12 and the outer layer 14 as shown in FIG. 2*d*, or the peripheral edges of the inner layer 12 and the outer layer 14 folded inward 33*e* as shown in FIG. 2*e*. Preferably, the peripheral material edges of the inner layer 12 and the outer layer 14 will have the double layer piping 33*a* as shown in FIG. 2*a*.

The trauma utility belt 10 may be made of an elastic material, for example a synthetic rubber material such as neoprene having an antimicrobial capability, with the inner layer 12 and the outer layer 14 being 50.8-13.21 cm (20-52 inches) in length, with the length dependent on the size of wearer's waist, and with each layer having a thickness 0.08 mm (1/32 inch) to 6.35 mm (⅛ inches), preferably 3.18 mm (⅛ inch) for the outer layer 14 and 3.18 mm (⅛ inch) for the inner layer 12. The accessory layer has a thickness 0.08 mm (1/32 inch) to 6.35 mm (⅛ inches), preferably 6.35 (⅛ inch). The first end portion 16 and the second end portion 24 each having a length approximately the length of the belt 10 as measured along the longitudinal axis of the belt 10; the first, the second, the third and the fourth taper portions each having a length approximately 1/24 the length of the belt as measured along the longitudinal axis of the belt 10; and the first and the second hip portions each having a length approximately 1/24 the length of the belt 10 as measured along the longitudinal axis of the belt 10. The elastic material combines the desired characteristics of flexibility and elasticity, allowing the material to expand and contract to the shape of the object around which the material is wrapped. The neoprene material can be easily cleaned, and additionally, the antimicrobial capability will help destroy and inhibit the growth of microorganisms and especially pathogenic microorganisms.

Figure 3A:
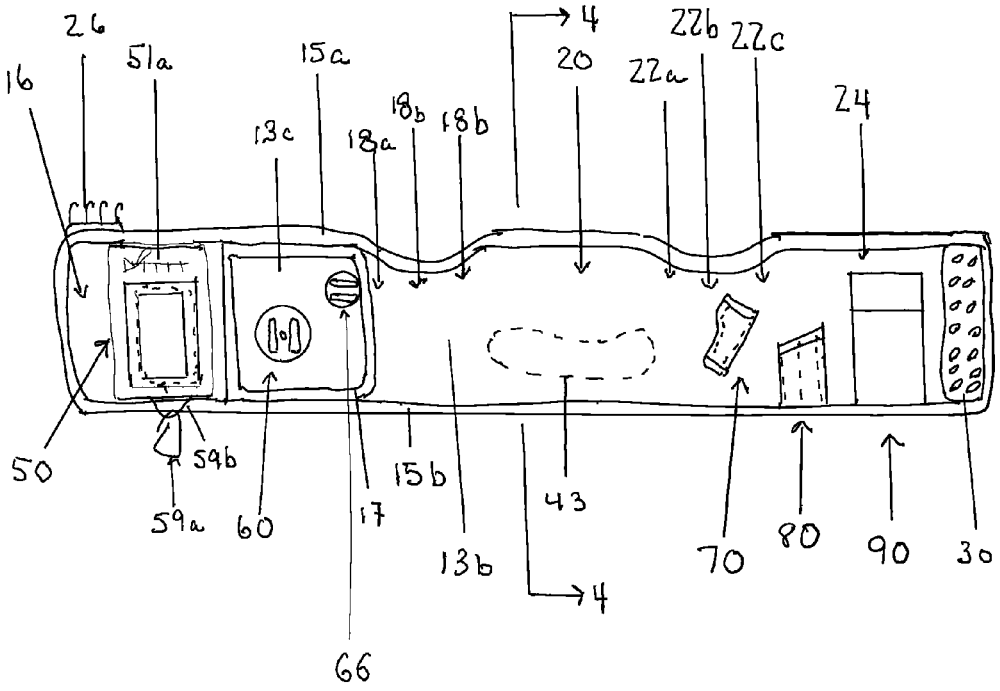
FIG. 3*a* is view of the exposed outer surface the utility belt in one plane FIG. 3*b* a cross sectional view taken along line 3*b*-3*b* of FIG. 1
Figure 3B:
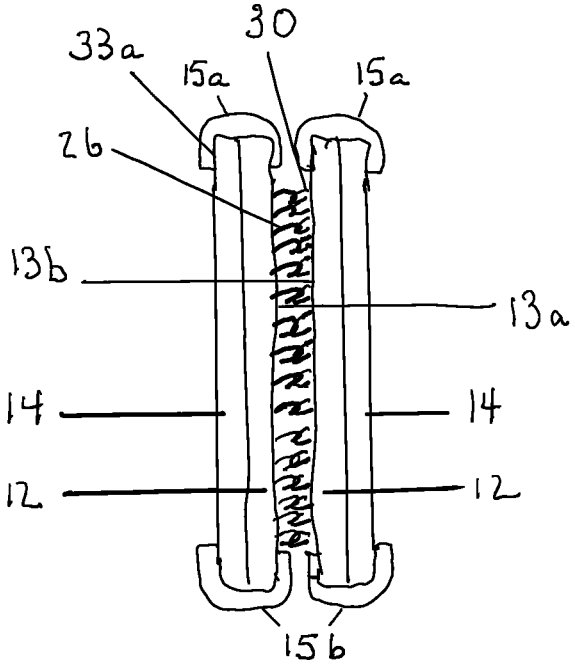
Figure 4:
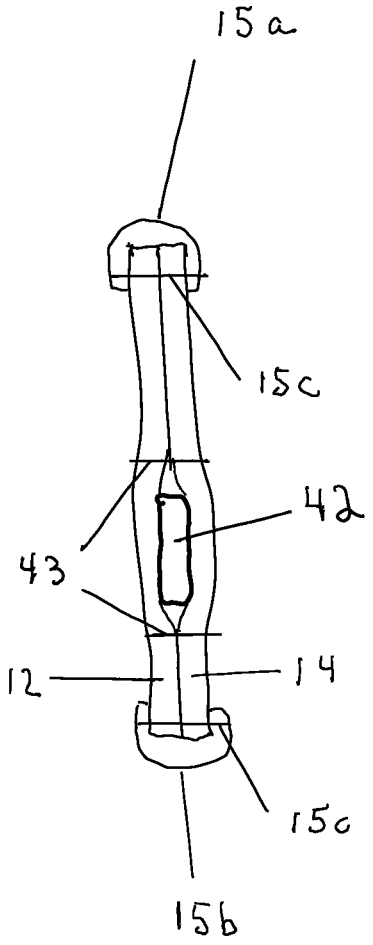
FIG. 4 is a cross sectional view taken along line 4-4 of FIG. 1

A belt first end fastener 26 as shown in FIG. 3*a* and FIG. 3*b* is mounted to the exposed surface 13*a* of the inner layer 12 of the first end portion 16 and fastens to a second end fastener 30 that is mounted to the exposed surface 13*b* of the outer layer 14 of the second end portion 24. The first end fastener 26 may consist of hooks and the second end fastener 30 may consist of loops. A particular design of fastening device is illustrated, but the first end portion 16 of belt 10 may also be fastened to the second end portion 24 of belt 10 and secured around a person's waist with one of a buckle (not shown) or a snap fastener (not shown), but preferably a hook first end fastener 26 and a loop second end fastener 30. The first end portion 16 and the second end portion 24 have a width between 190-229 mm (7.5-9.0 inches), preferably 222 mm (8.75 inches), with the width of each portion and the mid portion 20 being constant as measured transverse to the longitudinal axis from the upper edge 15*a* to the lower edge 15*b*. The first end portion 16 is connected to the first taper portion 18*a*, with the upper edge 15*a* of the first taper portion 18*a* tapering down from the constant width of the first end portion 16 to a narrower constant width of the first hip portion 18*b*, with the first hip portion 18*b* having a width between 127-178 mm (5-7 inches), preferably 175 mm (6.9 inches). The first hip portion 18*b* is connected to the second taper portion 18*c*, the upper edge 15*a* of the second taper portion 18*c* tapering up from the narrower first hip portion 18*b* to the wider constant width mid portion 20, having a width between 190-229 mm 7.5-9 inches), preferably 222 mm (8.75 inches). The mid portion 20 is connected to the third tapper portion 22*a* with the upper edge 15*a* of the third taper portion 22*a* tapering from the wider constant width mid portion 20 to the narrower second hip portion 22*b*, with the second hip portion 22*b* having a constant width equal to the width of the first hip portion 18*b*. The second hip portion 22*b* is connected to the fourth taper portion 22*c* with the upper edge 15*a* of the fourth taper portion 22*c* tapering up from the narrower constant width second hip portion 22*b* to the wider constant width second end portion 24. Referring to FIGS. 3*a* and 4, a pad 42 is positioned between the inner layer 12 and the outer layer 14 of the mid portion 20 to provide additional lumbar and lower back support when the belt 10 is tightened around the lower abdomen of a person. The pad 42 is made of a supporting material; more specifically the pad 42 is preferably made of high density foam. The pad 42 may have a width between 25.4-101.6 mm (1 to 4 inches), preferably 50.8 mm (2 inches) as measured traverse to the longitudinal axis the pad 42; a thickness between 12.7-50.8 mm (0.5 and 2 inches), preferably 25.4 mm (1 inch); a length 12.7-76.2 mm (0.5 to 3 inches) less than the length of the mid portion 20 as measured along the longitudinal axis of the belt 10, preferably the pad 42 has length 50.8 mm (2 inches) less that the length of the mid portion 20. The pad 42 is held in position between the inner layer 12 and the outer layer 14 by a pad row of stitches 43 around the perimeter of the pad 42 connecting the inner layer 12 and the outer layers 14 of belt 10. The pad 42 is positioned so that any portion of the pad closest to the lower edge 15*b* is 1.5 inches from the lower edge 15*b*.

Looking again at FIG. 1, a plurality of material and equipment holding devices may be attached to the belt 10, for example: a personal items pouch 50 to hold personal items; a stethoscope chest piece holder 60 to hold a stethoscope's chest piece AA; a retainer 66 to hold a stethoscope's first ear tube ET1 and second ear tube ET2; a holster 70 for a pair of trauma shears 71, a pen holder 80 for pens, such as first pen 81*a* and second pen 81*b*; and a communications compartment 90 for communications equipment. The preferred placement for the material and equipment holding devices is for the personal items pouch 50, the stethoscope chest piece holder 60 and the retainer 66 to evenly spaced and located in order along the longitudinal axis of the belt 10 on the exposed surface 13*b* of the outer layer 14 of the first end portion 16, the first taper portion 18*a*, the first hip portion 18*b*, and the second taper portion 18*c*; and the holster 70, the pen holder 80, and the communications compartment 90 may be equally spaced and located in order along the longitudinal axis of the belt 10 on the exposed surface 13*b* of the outer layer 14 of the third taper portion 22*a*, the second hip portion 22*b*, the fourth taper portion 22*c*, and the second end portion 24. The locations and spacing of the various material and equipment holding devices along outer layer 14 can be modified as required. The peripheral material edges of the personal items pouch 50, the holster 70, the pen holder 80, and the communications compartment 90 preferably are folded inward 33*e* as shown in FIG. 2*e* unless otherwise indicated. An optional back pocket (not shown) may be formed between the inner layer 12 and the outer layer 14 of the mid portion 20 above the pad 42. The optional pad pocket (not shown) may be accessed by an optional pocket slit (not shown) in the outer layer 14 of the belt 10 with the pocket slit (not shown) running generally parallel to the upper edge 15*a*, and generally having a length somewhat less than the length of the pad 42, with the pocket slip (not shown) located one inch below the upper edge 15*a* of the mid portion 20. The personal items pouch 50, the trauma shears holster 70, the pen holder 80, and the communications compartment 90*a*, and the optional pad pocket (not shown), may be made of the same material as the outer layer 14 and may have the antimicrobial capability. The belt 10 and plurality of material and equipment holding devices, such as the personal items pouch 50 the stethoscope chest piece holder 60, the retainer 66, the holster 70, the pen holder 80, and the communications compartment 90 may be made of materials infused with the antimicrobial capability or may be coated with an antimicrobial composition.

Figure 5A:
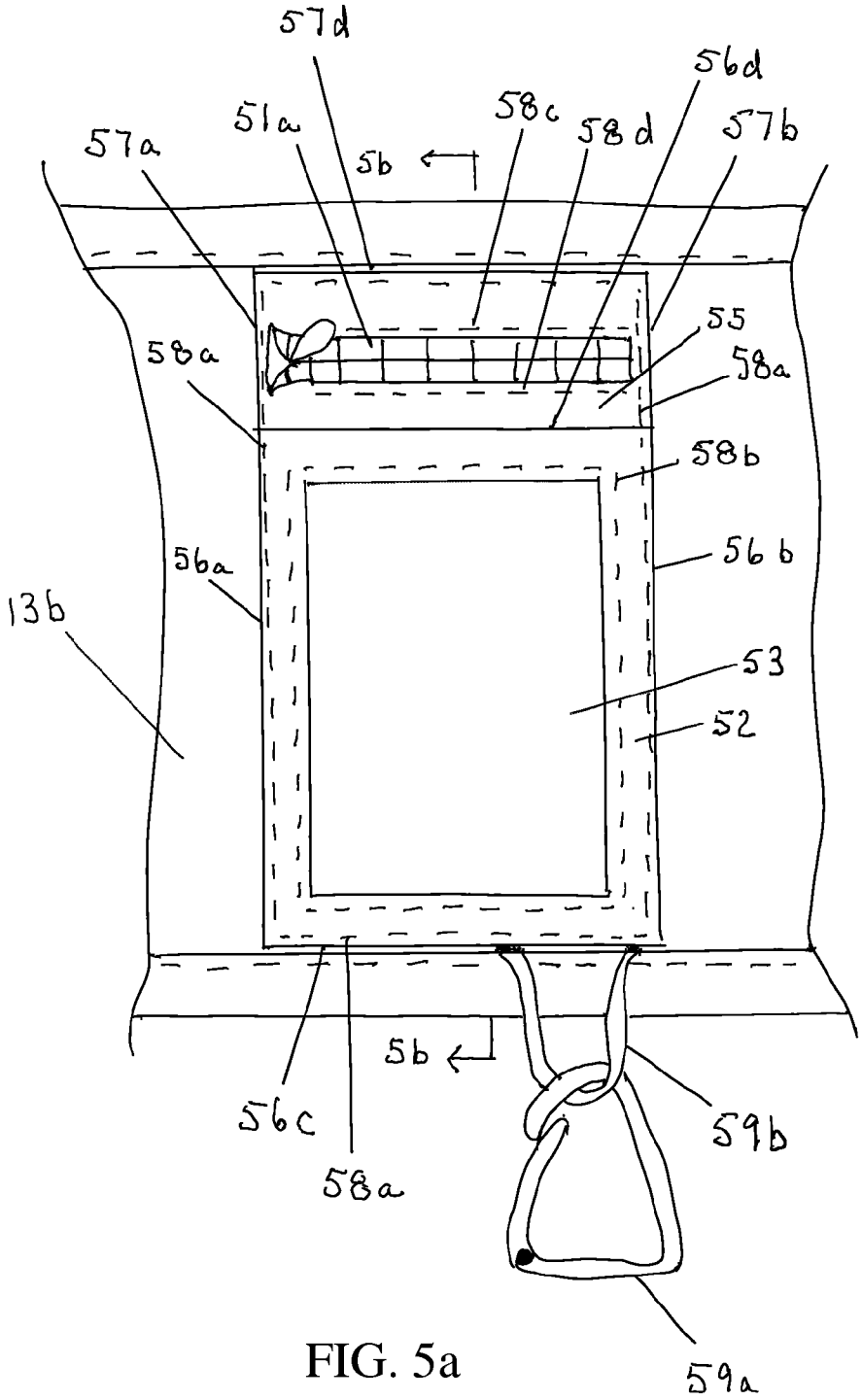
FIG. 5*a* is a frontal view of the personal items pouch
Figure 5B:
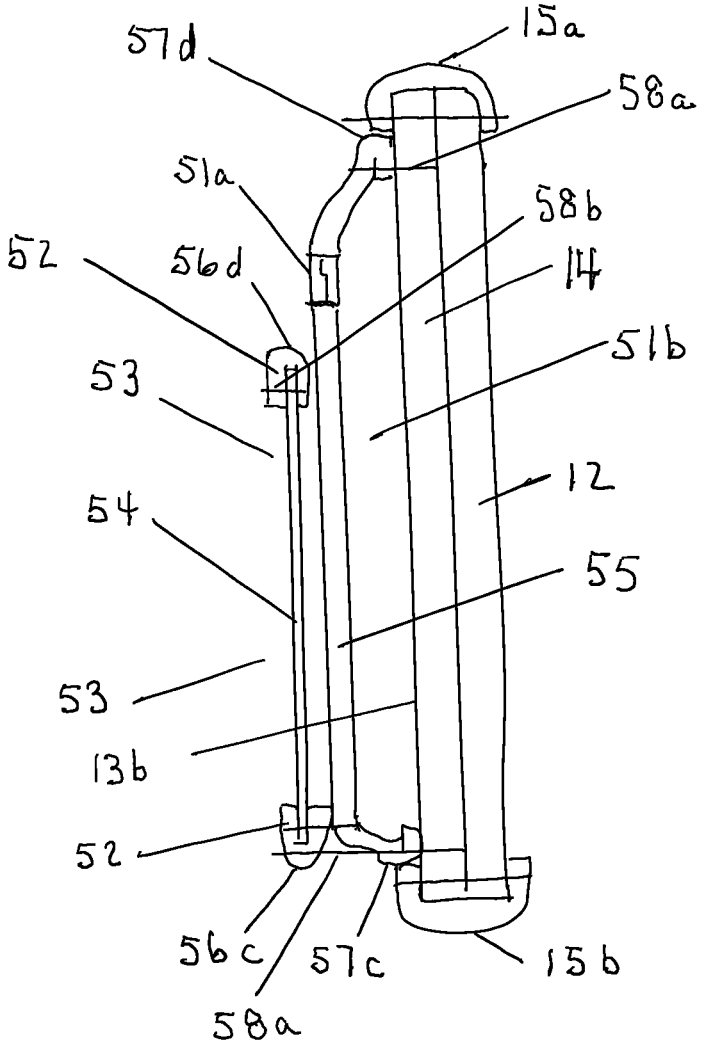
FIG. 5*b* is a cross sectional view taken along line 5*b*-5*b* of FIG. 5*a*

The personal items pouch 50 shown in FIGS. 1 and 3, and more particularly FIG. 5*a*, has a pouch zipper 51*a* that is used to access and secure a pouch volume 51*b* shown in FIG. 5*b*. The personal items pouch 50 has a pouch first panel 52 having a rectangular cutout 53 that is centered on the first panel 52 with the rectangular cutout 53 sized to view a standard identification card through a transparent sheet 54 that is cut to the shape of the rectangular cutout 53, with the transparent sheet 54 being somewhat larger than the rectangular cutout 53, and the transparent sheet 54 being placed between the rectangular cutout 53 and a second panel 55, with the second panel 55 being between the transparent sheet 54 and the exposed surface 13*b* of the outer layer 14 of the belt 10. The identification card will generally be 85.73 mm (3.375 inches) long by 76.2 mm (3.0 inches) wide and may be inserted between the transparent sheet 54 and the second panel 55. The pouch volume 51*b* is formed between the second panel 55 and the exposed surface 13*b* of the outer layer 14 of the belt 10. The first panel 52 has a convex first panel first side edge 56*a*, a convex first panel second side edge 56*b*, a convex first panel bottom edge 56*c*, and a convex first panel top edge 56*d*. The second panel 55 has a convex second panel first side edge 57*a*, a convex second panel second side edge 57*b*, a convex second panel bottom edge 57*c*, and a convex second panel top edge 57*d*. Looking at FIG. 5*b*, the convex first panel bottom edge 56*c* and the convex first panel top edge 56*d* are formed by folding the peripheral edge of the first panel 52 around the peripheral edge of the transparent sheet 54, and back onto the transparent sheet 54. Similarly, the convex first panel first side edge 56*a* and a convex first panel second side edge 56*b* are formed. Looking again at FIG. 5*b*, the convex second panel bottom edge 57*c* and the convex second panel top edge 57*d* are formed by folding the peripheral edge of the second panel 55 back onto itself. Similarly, the convex second panel first side edge 57*a* and the convex second panel top edge 57*d* are formed. Looking again at FIGS. 5*a* and 5*b*, the first panel first side edge 56*a*, the first panel bottom edge 56*c*, the first panel second side edge 56*b*, are aligned with the second panel first side edge 57*a*, the second panel bottom edge 57*c*, and the second panel second side edge 57*b*, respectively, and secured to the outer layer 13 of the belt 10 by a first row of stitches 58*a* through the first panel 52 and the second panel 55 around the second panel first side edge 57*a*, the second panel bottom edge 57*c*, and the second panel second side edge 57*b*, and the second panel top edge 57*d*, allowing the identification card to be inserted between the first panel top edge 56*d* and the second panel 55, with the card finally being positioned between the transparent sheet 54 and second panel 55. The pouch zipper 51*a* runs generally parallel to the longitudinal axis of the belt 10, with the zipper 51*a* located preferably 6.25 mm (0.25 inches) below the second panel top edge 57*d* and 6.25 mm (0.25 inches) from the second panel first side edge 57*a* and 6.25 mm (0.25 inches) from the second panel second side edge 57*b*. Looking at FIGS. 5*a* and 5*b*, the transparent sheet 54 is generally rectangular and made of high density polyethylene with a sheet thickness between 1.27-2.29 mm (0.05-0.09 inches), preferably of 0.79 mm (0.031 inches). The transparent sheet 54 is somewhat larger than the rectangular cutout 53, is centered on the rectangular cutout 53, is positioned adjacent to the first panel 52, and is secured to the first panel 52 by a second row of stitches 58*b* around the rectangular cutout 53. The zipper 51*a* is attached to the second panel 55 by a third row of stitches 58*c* and a fourth row of stitches 58*d*. The personal items pouch 50 has a width as measured along a line parallel to the longitudinal axis of belt 10 between the second panel first side edge 57*a* and the second panel second side edge 57*b*, of generally between 89-114 mm (3.5-4.5 inches), preferably a width of 102 mm (4 inches). The pouch 50 has a length as measured perpendicular to the longitudinal axis of the belt 10 between the second panel bottom edge 57*c* and the second panel top edge 57*d*, generally between 127 mm and 215.9 mm (5 and 8.5 inches), preferably 114 mm (4.5 inches). The personal items pouch first panel 52 and the second panel 55 may have an antimicrobial capability and may be made of the same materials as the outer layer 14 of the belt 10. The pouch zipper 51*a* and the transparent sheet 55 are made of materials infused with the antimicrobial composition or coated with the antimicrobial composition, but preferably made of materials infused with the antimicrobial composition providing the antimicrobial capability.

Looking again at FIG. 5*a*, a plurality of holding devices, such as a snap hook 59*a* on a cord 59*b* attached to the personal items pouch 50, may be attached anywhere on the exposed surface 13*b* of the outer layer 14 the belt 10 and may also be attached to the trauma shears holster 70, the pen and pencil and pen holder 80 and the communications compartment 90.

Figure 6A:
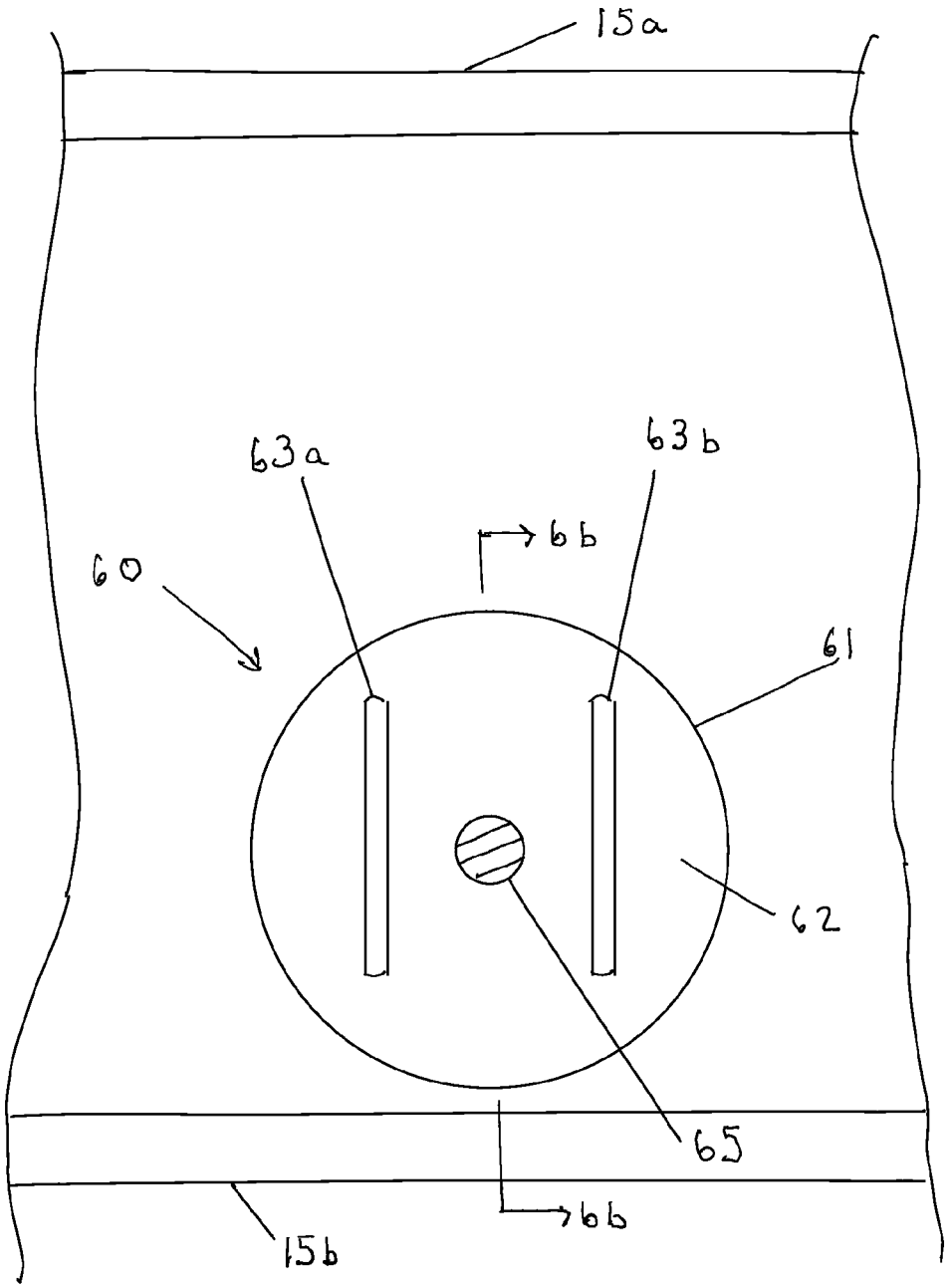
FIG. 6*a* is a frontal view of stethoscope chest piece holder
Figure 6B:
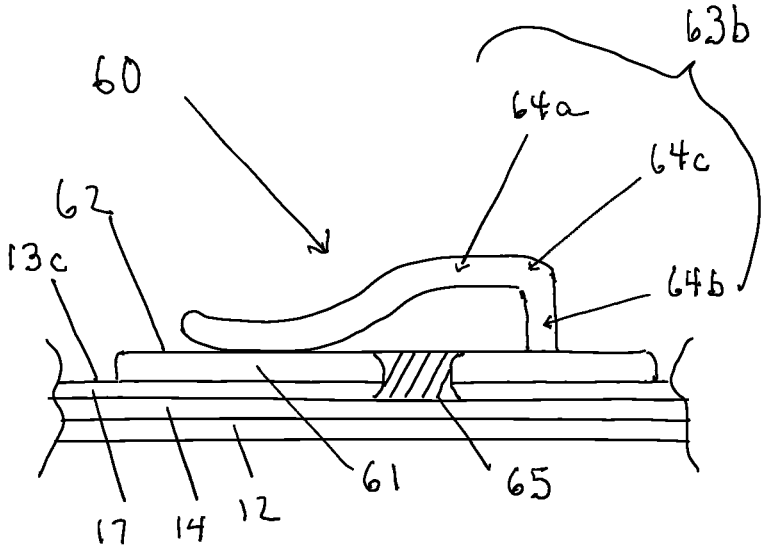
FIG. 6*b* is a cross sectional view taken along line 6*b*-6*b* of FIG. 6*a*
Figure 6C:
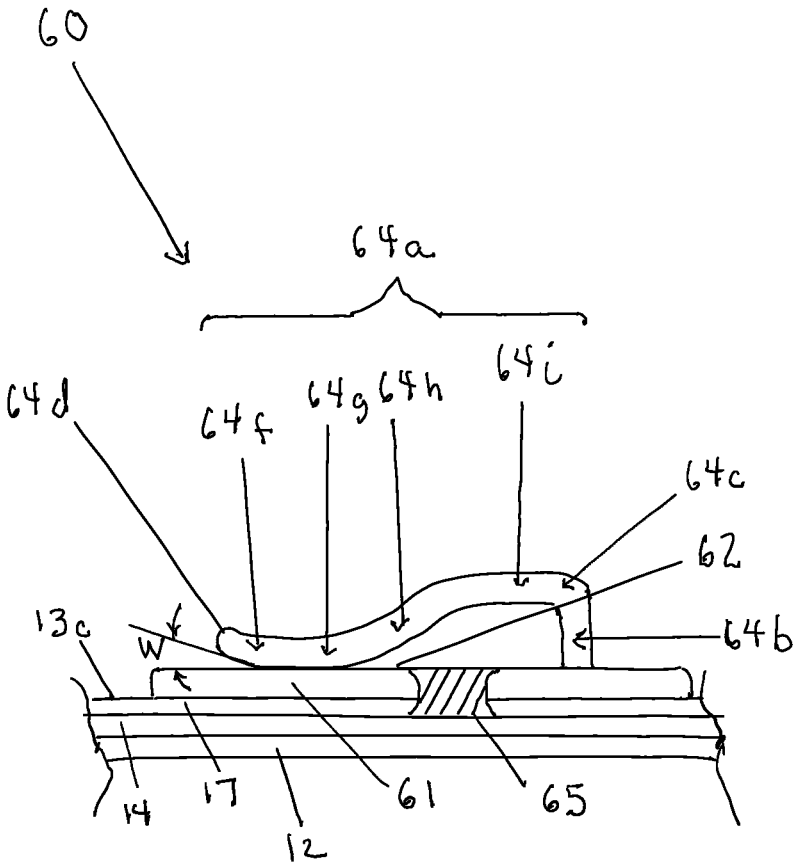
FIG. 6*c* is a view of the free end portion of a clip in distinct portions
Figure 6D:
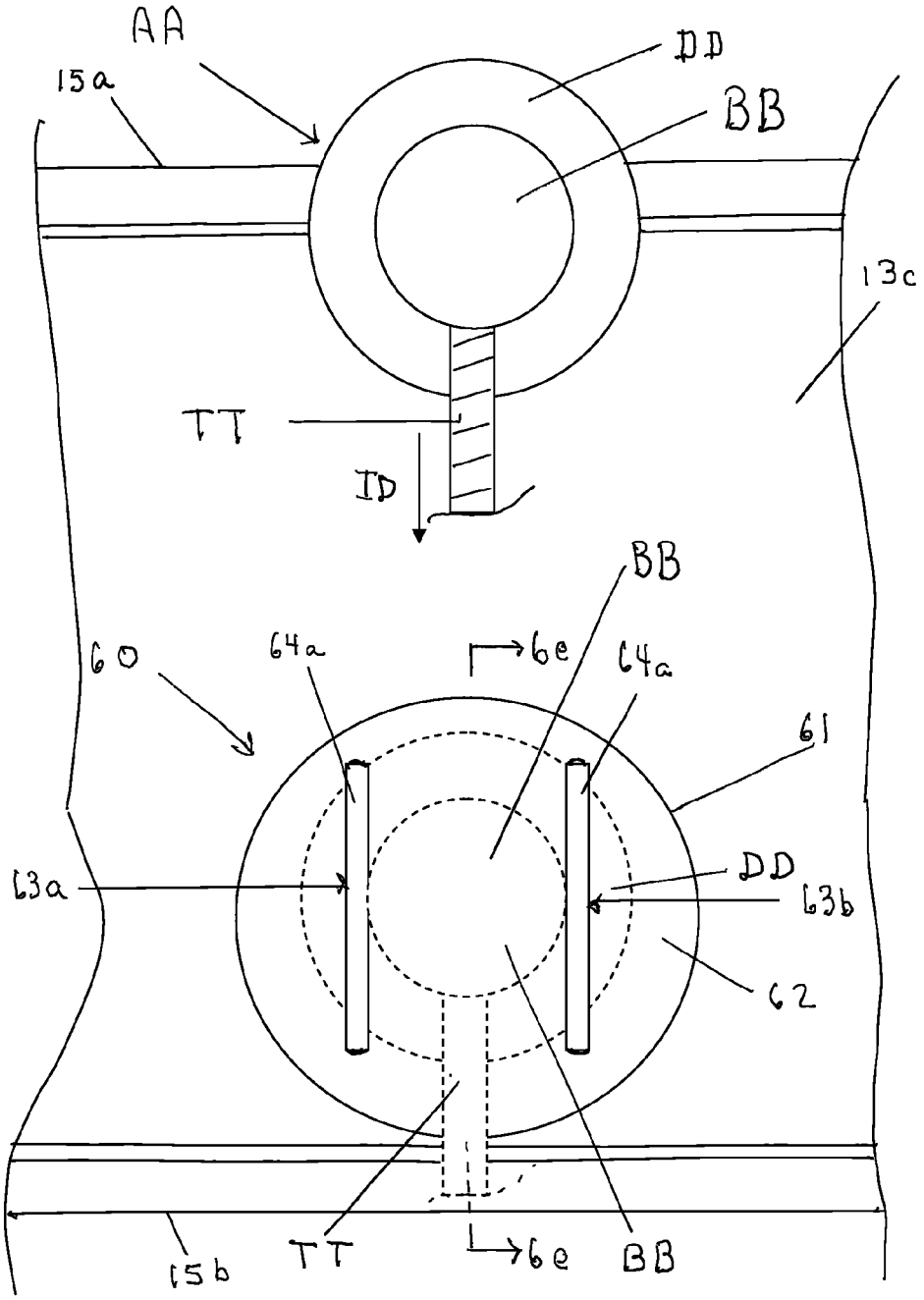
FIG. 6*d* is a frontal view of stethoscope chest piece holder with a stethoscope chest piece being inserted
Figure 6E:
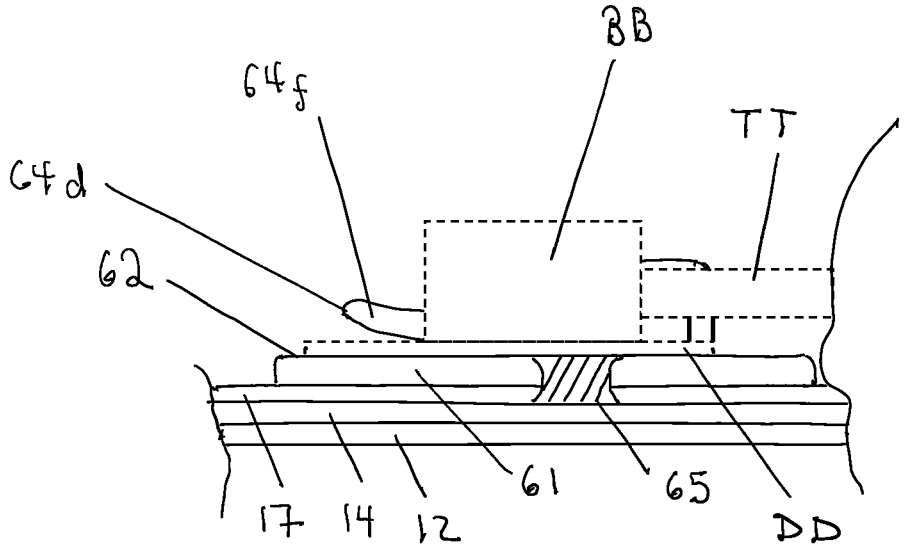
FIG. 6*e* is a cross sectional view taken along line 6*e*-6*e* of FIG. 6*d*

Looking at FIGS. 1 and 3*a*, and more specifically at FIGS. 6*a*, and 6*b*, the stethoscope chest piece holder 60 has a disk 61 with a disk outer surface 62 on which a first clip 63*a* and a second clip 63*b* are mounted. The disk 61 is preferably a cylindrical plate. The first clip 63*a* and the second clip 63*b* are generally identical circular shaped clips mounted parallel to each other, and of a predetermined clip configuration. Looking a FIG. 6*b*, a sectional view along line 6*b*-6*b* in of FIG. 6*a*, the predetermined clip configuration, illustrated by the second clip 63*b*, shows that the second clip 63*b* comprises a generally an "L" shaped clip, having a free end portion 64*a* joined to a base portion 64*b* at a 90 degree clip elbow 64*c*. Looking at FIG. 6*c*, another view of FIG. 6*b*, the free end portion 64*a* has a generally hemispherical free end tip 64*d* and the base portion 64*b* is adjacent to the disk outer surface 62 of the disk 61 where the base portion 64*b* is mounted perpendicular to the disk outer surface 62 of the disk 61, with the base portion 64*b* at least 3 mm from the perimeter of the disk outer surface 62. The free end portion 64*a* has an insert portion 64*f*, a hold portion 64*g*, a curved portion 64*h*, and a parallel portion 64*i*. The insert portion 64*f* is located between the free end tip 64*d* and the hold portion 64*g*, and the insert portion 64*f* is angled away from the disk outer surface 62 with the insert portion 64*f* forming an angle between 10 and 60 degrees with the disk outer surface 62, preferably an angle W of 20 degrees. The curved portion 64*h* is located between the hold portion 64*g* and the parallel portion 64*i*. The parallel portion 64*i* is generally parallel to the disk outer surface 62 and between the clip elbow 64*c* and the curved portion 64*h*, and the parallel portion 64*i* has a length generally equal to the length of the free end portion 64*a* as measured along the longitudinal axis of the free end portion 64*a*. The hold portion 64*g* is located between the curved portion 64*h* and the insert portion 64*f*, and is generally ¼ the length of the free end portion 64*a*. The insert portion is generally ⅛ the length of the free end portion 64*a* with the length of the insert 64*f* as measured along its longitudinal axis from free end tip 64*d* to the hold portion 64*g*. The curved portion curves downward toward the disk outer surface 62 from the parallel portion 64*i* to the hold portion 64*g*. Looking at FIGS. 6*d*, 6*e*, and 6*f*, the first clip 63*a* and the second clip 63*b* are configured to hold the stethoscope chest piece AA having a stethoscope chest piece bell BB, a diaphragm DD, and an ear tube stem TT. The stethoscope chest piece AA is inserted in the chest piece holder 60 in an insert direction ID by slipping the ear tube stem TT and then the chest piece bell BB between the free portion 64*a* of the first clip 63*a* and the free end portion 64*a* of the second the clip 63*b*, such that the chest piece bell BB is adjacent to the free portions, such as the clip free end portion 64*a* of the first clip 63*a* and the clip free end portion 64*a* of the second clip 63*b*, and the chest piece diaphragm DD is adjacent to the disk outer surface 62 and held by the hold portions, such as the hold portion 64*g* of the first clip 63*a* and the hold portion 64*g* of the second clip 63*b*. Looking again at FIGS. 6*a* and 6*b*, a disk rivet 65 through the center of the disk 61 attaches the disk 61 to the exposed surface 13*c* of the accessory layer 17 of the belt 10, and allows the disk 61, and consequently the stethoscope chest piece holder 60, to rotate around the disk rivet 65, allowing the stethoscope chest piece diaphragm DD to be easily inserted in the stethoscope chest piece holder 60. The disk rivet 65 is between 6-12 mm in diameter, preferably 8 mm. A key feature of the stethoscope chest piece holder 60 is that the disk 61 is made of a material containing an antimicrobial composition reducing the likelihood of the transmission of dangerous diseases. Looking at FIGS. 6*b* and 6*c*, the preferred shape of the second clip 63*b* is generally cylindrical with the hemispherical free end tip 64*d* shown in FIGS. 6*b* and 6*c*, but the shape may also be elliptical (not shown) or rectangular (not shown). The disk 61 is between 5.5 cm and 7 cm in diameter, preferably 6 cm, and is 2 mm to 6 mm thick, preferably 3 mm thick. The disk 61, the first clip 63*a*, and the second clip 63*b* may be made of a high density polyethylene, a stainless steel, an aluminum, or a polymer, infused with an antimicrobial composition, but preferably the disk 61, the first clip 63*a* and the second clip 63*b* are made of high density polyethylene. When the antimicrobial composition is not infused in the materials of the disk 61, the first clip 63*a* and the second clip 63*b*, and the disk rivet 65, an antimicrobial coating (not shown) may be applied to the disk 60, the first clip 63*a* and the second clip 63*b* with the antimicrobial coating being between is 0.1 to 0.5 mm thick, preferably 0.25 mm thick. Excluding any coatings, the first clip 63*a* and the second clip 63*b* each have a diameter between 4 and 8 mm, preferably 6 mm; a base portion length between 10.16 mm and 17.78 mm, preferably 12.7 mm; a free end portion length between 25.4 mm to 38.1 mm preferably 35 mm.

Figure 6F:
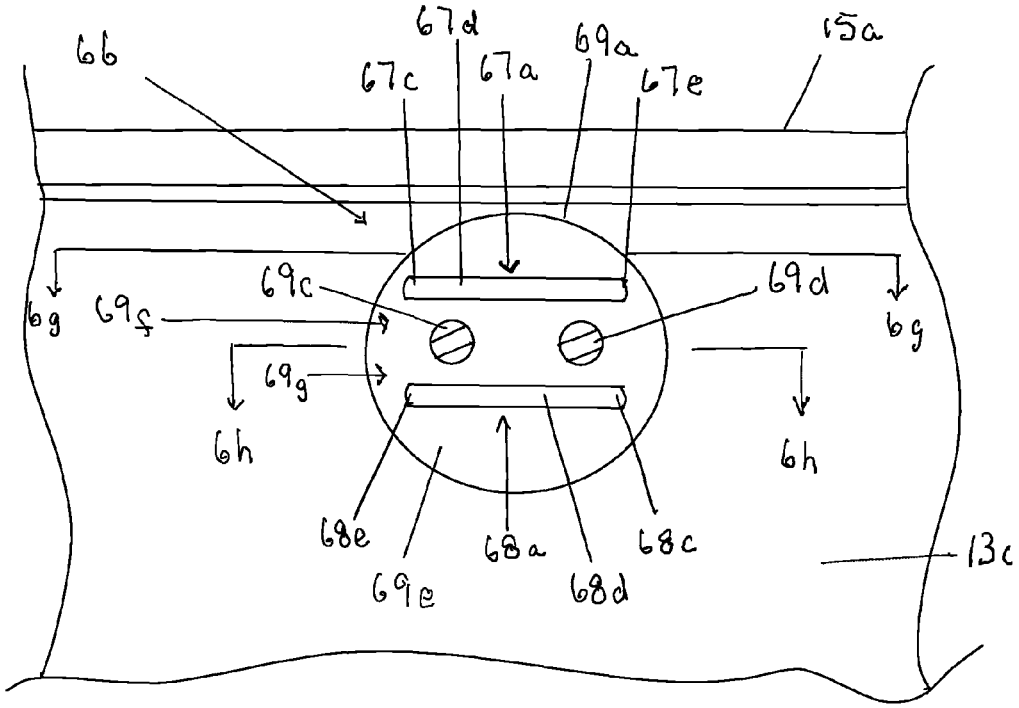
FIG. 6*f* is a frontal view of a stethoscope ear tube retainer with a first post mounted above a second post
Figure 6G:
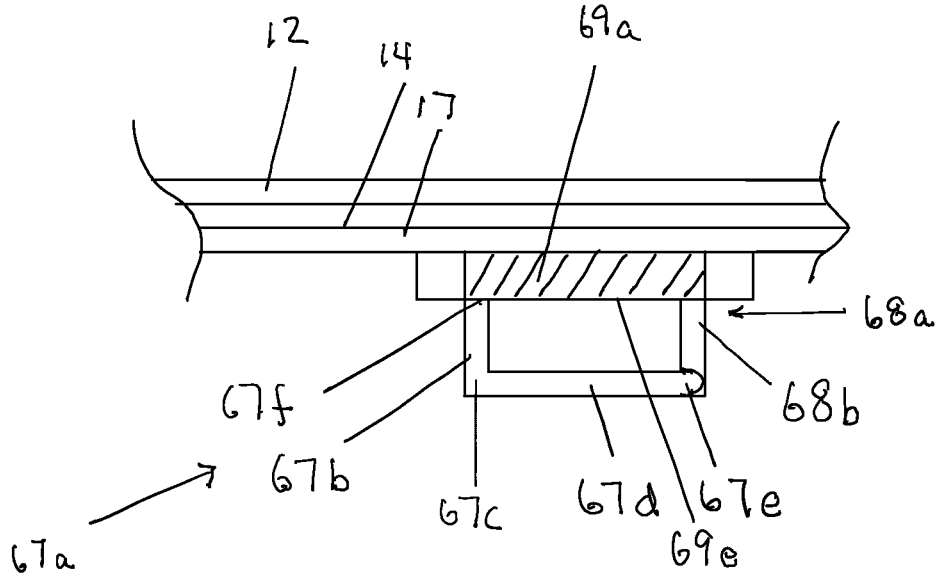
FIG. 6*g* is a cross sectional view taken along line 6*g*-6*g* of FIG. 6*f*
Figure 6H:
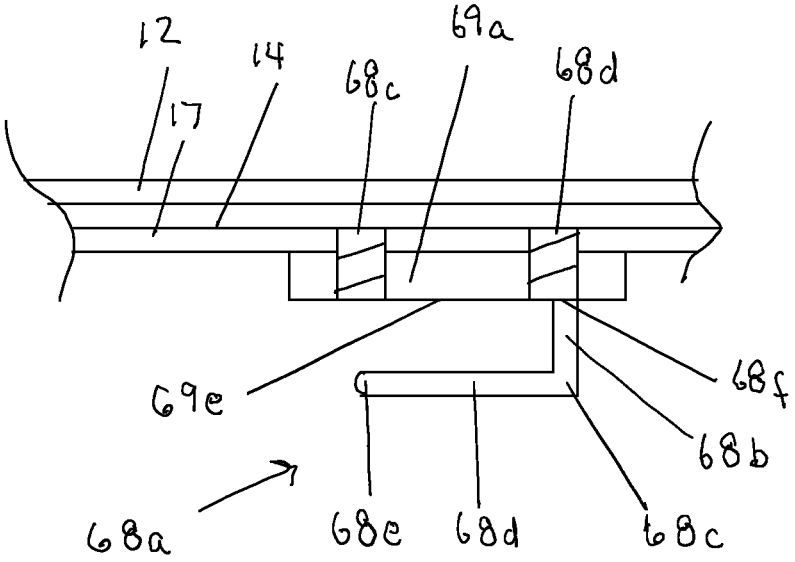
FIG. 6*h* is a cross sectional view taken along line 6*h*-6*h* of FIG. 6*f*
Figure 6I:
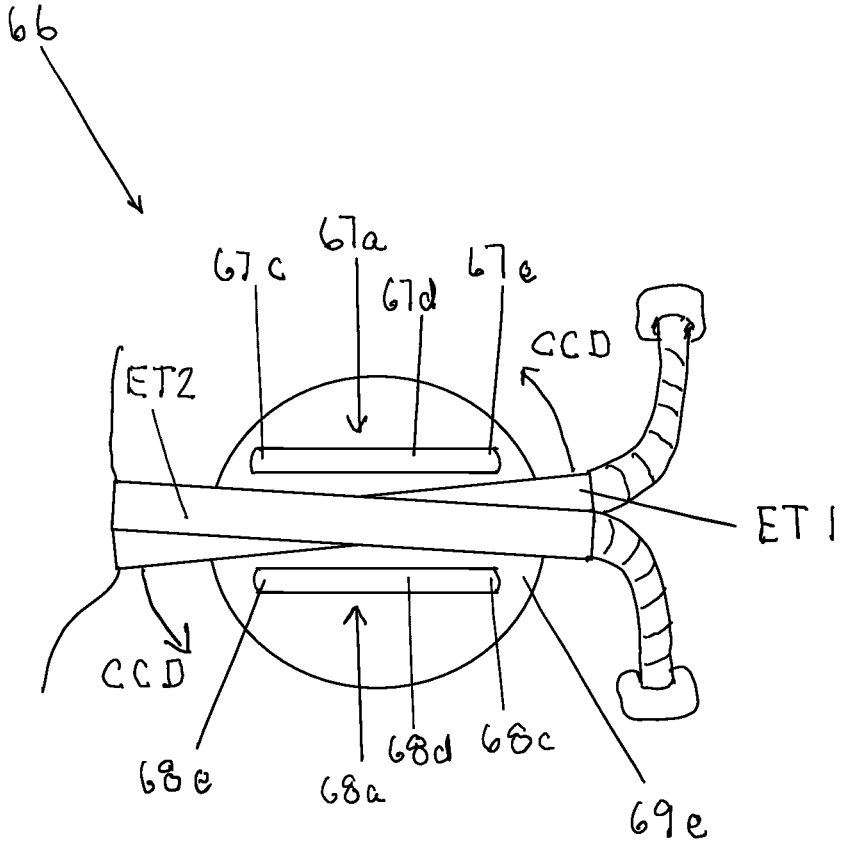
FIG. 6*i* is a frontal view of the stethoscope ear tube retainer with the ear tubes inserted and the first post mounted above the second post
Figure 6J:
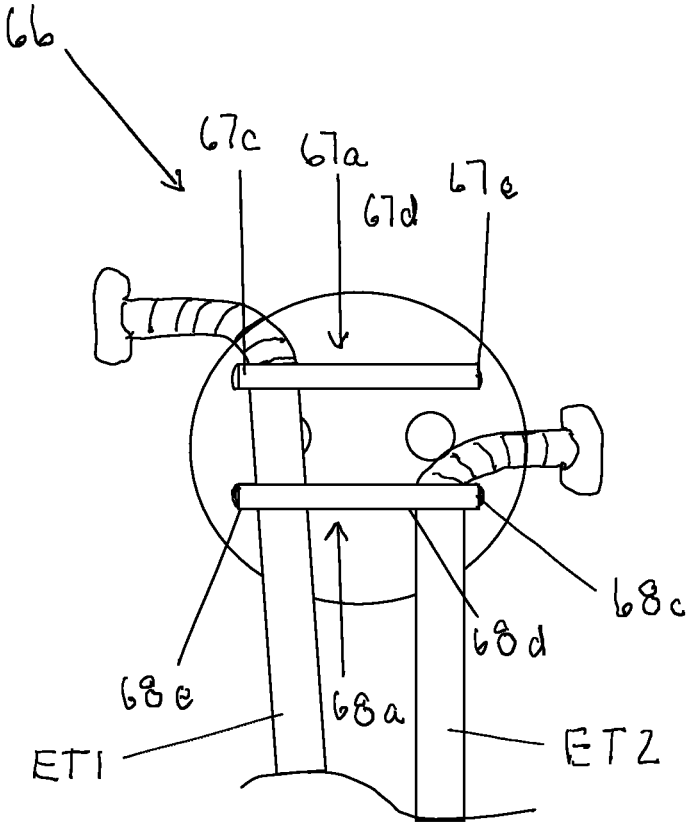
FIG. 6*j* is a frontal view of the stethoscope ear tube retainer with the ear tubes inserted and turned counter clockwise
Figure 6K:
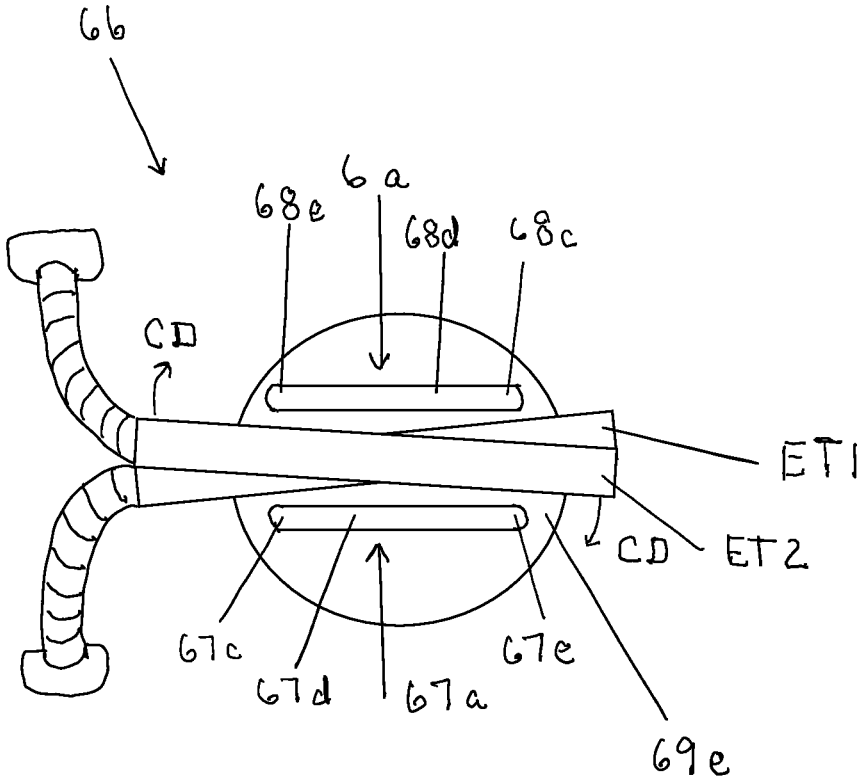
FIG. 6*k* is a frontal view of the stethoscope ear piece tube retainer with the ear tubes inserted and the first post mounted below the second post
Figure 6M:
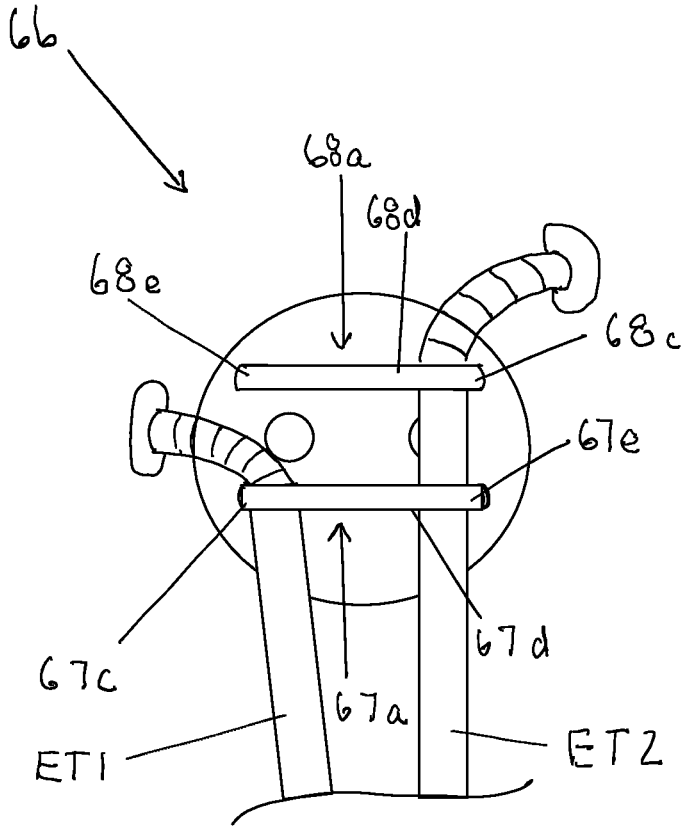
FIG. 6*m* is a frontal view of the stethoscope ear tube retainer with the ear tubes inserted and turned clockwise
Figure 7A:
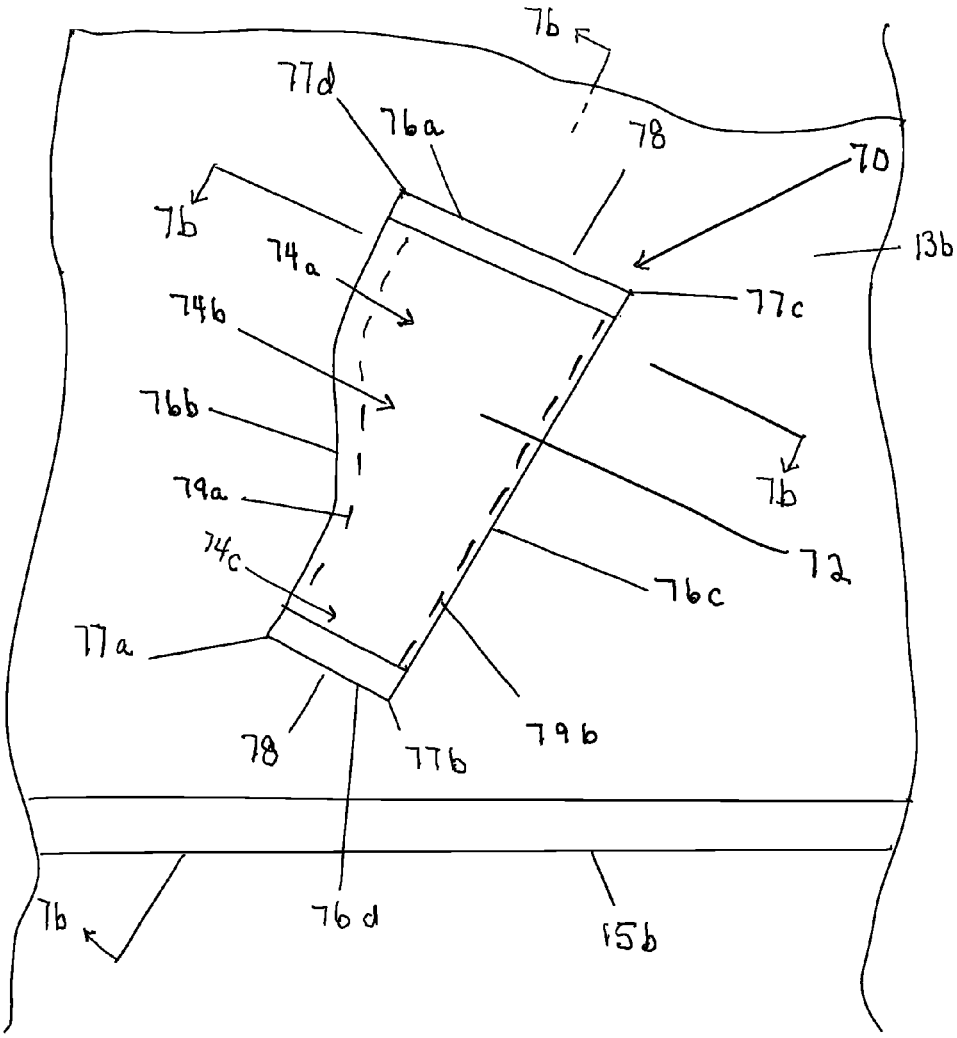
FIG. 7*a* is a frontal view of a trauma shears holster
Figure 7B:
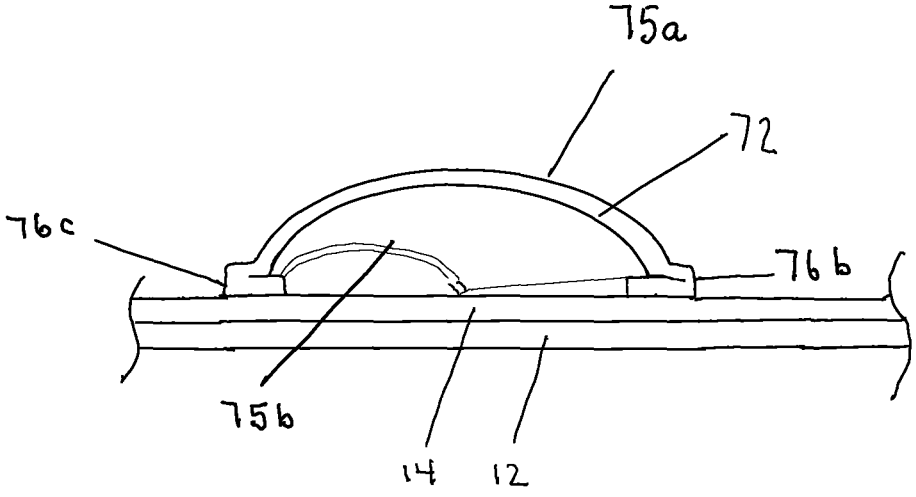
FIG. 7*b* is a cross sectional view taken along line 7*b*-7*b* of FIG. 7*a*
Figure 7C:
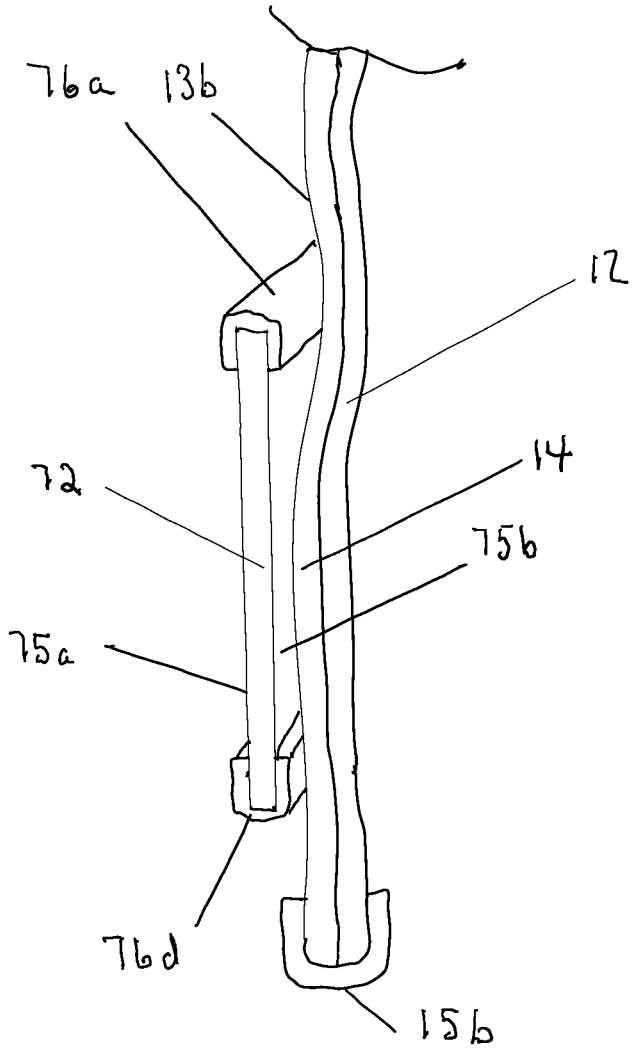
FIG. 7*c* is a cross sectional view taken along line 7*c*-7*c* of FIG. 7*a*

A retainer 66 for securing a stethoscope's ear tubes when a stethoscope chest piece is in the chest piece holder 60 is shown in FIGS. 1 and 3*a*, and more specifically in FIGS. 6*f*, 6*g* and 6*h*. The retainer 66 has two identical generally "L" shaped cylindrical post, a first post 67*a* and a second post 68*a*, and a base 69*a* with a base first side surface 69*e*. The first post 67*a* and the second post 68*a* are mounted to the base 69*a* parallel to each other. Looking at FIG. 6*g*, the first post 67*a* has a first post short leg portion 67*b* with a first post base end 67*f*, a first post elbow portion 67*c* and a first post long leg portion 67*d* with a first post hemispherical end 67*e*. The first post elbow portion 67*c* is located between the first post short leg portion 67*b* and the first post long leg portion 67*d*. Looking at FIG. 6*h*, the second posts 68*a* has a second post short leg portion 68*b* with a second post base end 68*f*, a second post elbow portion 68*c*, and a second post long leg portion 68*d* with a second post hemispherical end 68*e*. The second post elbow portion 68*c* is located between the second post short leg portion 68*b* and the second post long leg portion 68*d*. The first post base end 67*f* and second post base end 68*f* of the first post short leg portions 67*b* and the second post short leg portion 68*b*, respectively, are adjacent to first side surface 69*e* of the base 69*a* with the first post short leg portion 67*b* and the second port short leg portion 68*b* being generally perpendicular to the base first side surface 69*e*. The first post long leg portion 67*d* with the first post hemispherical end 67*e* and second post long leg portion 68*d* with the second post hemispherical end 68*e* are parallel to each other and parallel to the longitudinal axis of the belt 10. The base 69*a* is symmetrically divided into a base first portion 69*f* and a base second portion 69*g* with the first post 67*a* located in the base first portion 69*f* and the second post 68*a* located in the base second portion 69*g* with the first post hemispherical end 67*e* is directly above the second post elbow portion 68*d*. The first post 67*a* and the second post 68*a* have a diameter between 3 mm and 8 mm, preferably 4 mm. The first post short leg portion 67*b* and the second post short leg portion 68*b* are between 15 mm and 30 mm long, preferably 20 mm long, and first post long leg portion 67*d* and second post long leg portions have a length between 20 and 40 mm, preferably 35 mm. Although elliptical (not shown) and rectangular (not shown) base shapes are possible, the preferred shape for the base 69*a* is the cylindrical base having the circular first side surface 69*e* shown in FIGS. 6*a* and 6*b*. The first post hemispherical end 67*e* and second post hemispherical end 68*e* have a radius ½ the diameter of the first post 67*a* and the second post 68*a*, respectively. The base 69*a* is between 40-70 mm in diameter, preferably 60 mm, and has a thickness between 2-8 mm, preferably 5 mm. The retainer 66 may be mounted on the exposed surface 13*c* of the accessory layer 17 of the belt 10 and is generally 2.5 to 6.0 cm, preferably 5 cm above the longitudinal axis of the belt 10 and between the chest piece holder 60 and the mid portion 20 approximately 5-15 cm from the chest piece holder 60, preferably 6 cm. The base 69*a* as shown FIGS. 6*f* and 6*h* may be attached to the exposed surface 13*c* of the accessory outer layer 17 of the belt 10 with a two tarp rivets, a base first rivet 69*c* and a base second rivet 69*d* having a diameter of 3-6 mm, preferably 4 mm. Looking at FIG. 6*i*, to secure the stethoscope's first ear tube ET1 and the second ear tube ET2 in the retainer 66, the retainer 66 is sized and configured to allow a the first ear tube ET1 and the second ear tube ET2 to be inserted between the first post 67*a* and the second post 68*a* and then the first ear tube ET1 and the second ear tube ET2 are rotated in a counter clockwise direction CCD toward the first post hemispherical end 67*e* and the second post hemispherical end 68*e* until the first ear tube ET1 and second ear tube ET2 are between the first post hemispherical end 67*e* and the first post elbow portion 67*c*, and also between the second post hemispherical end 68*e* and the second post elbow portion 68*c*, and with the first ear tube ET1 coming to rest on the first post 67*a* and the second ear tube ET2 coming to rest on the second post 68*a* retaining the first ear tube ET1 and the second ear tube ET2 in the retainer 66 as shown in FIG. 6*j*. Looking again at FIG. 6*f*, the first post long leg portion 67*d* and the second post long leg portion 68*d* are separated between 15-40 mm, preferably 20 mm. Looking at FIG. 6*k*, when the first post 67*a* is mounted below the second post 68*a*, so that the first post elbow portion 67*c* is now directly below second post hemispherical end 68*e*, the first ear tube ET1 and the second ear tube ET2 may be inserted between the first post 67*a* and the second post 68*a* and rotated in the clockwise direction CD resulting in the first ear tube ET1 being retained by the first post 67*a* and the second ear tube ET2 being retained by the second post 68*a* as shown in FIG. 6*m*. Although the retainer 66 shown in FIG. 6*f* is the preferable means to retain a stethoscope's ear tubes, a strap (not shown) or a hook (not shown) may also be used to retain the ear tubes. Looking at FIG. 6*f*, the hook (not shown) can easily be obtained by rotating the first post 67*a* so that the first post long leg portion 67*d* is perpendicular to the longitudinal axis of the belt 10 and the first post hemispherical end 67*e* is closest part of the first post 67*a* to the upper edge 15*a*. An the antimicrobial composition may be infused in the materials of the base 69*a*, the first post 67*a*, the second post 68*a*, the first rivet 69*c*, and the second rivet 69*d*. When the antimicrobial composition is not infused in the materials of the base 69*a*, the first post 67*a*, the second post 68*a*, the first rivet 69*c*, and the second rivet 69*d*, an antimicrobial coating (not shown) may be applied, with the antimicrobial coating being between is 0.1 to 0.5 mm thick, preferably 0.25 mm thick, giving the retainer 66 an antimicrobial capability A trauma shear holster 70 as shown in FIG. 7*a* is used to holster a pair of trauma shears 71 as shown in FIG. 1. The holster 70 has an elongated holster panel 72 of material divided into an entrance portion 74*a*, a holster taper portion, 74*b*, and a holster exit portion 74*c*, with the elongated holster panel 72 having an entrance edge 76*a*, a first side edge 76*b*, a second side edge 76*c*, and an exit edge 76*d*. Referring to FIGS. 7*a*, 7*b* and FIG. 7*c*, the holster panel 72 has a holster panel outer surface 75*a* and a holster panel inner surface 75*b*. The holster panel 72 is attached to the exposed surface 13*b* of the outer layer 14 of the belt 10 with a row of first side stitches 79*a* along the first side edge 76*b*, and a row of second side stitches 79*b* along the second side edge 76*c*. Referring again to FIG. 7*a*, the exit edge 76*d* and the first side edge 76*b* intersect to form a first corner 77*a*. The exit edge 76*d* and the second side edge 76*c* intersect to form a second corner 77*b*, the entrance edge 76*a* and the second side edge 76*c* intersect to form a third corner 77*c*, and the entrance edge 76*a* intersects with the first side edge 76*b* to form a fourth corner 77*d*. The holster 70 has a holster panel longitudinal axis 78 generally parallel to the second side edge 76*c* and symmetrically dividing the exit edge 76*d* into generally equal halves. The widths of the entrance portion 74*a* and the holster exit portion 74*c* being of generally constant as measured traverse to the holster longitudinal axis from the first side edge 76*b* to the second side edge 76*c* with the width of the holster entrance portion 74*a* being greater than the width of the holster exit portion 74*c*. The first side edge 76*b* tapers down from the constant width entrance portion 74*a* along the holster taper portion 74*b* to the narrower constant width holster exit portion 74*c*. Referring to FIG. 7*c*, the holster panel inner surface 75*b* of the holster panel 72 is positioned facing the exposed surface 13*b* of the outer layer 14 of the belt 10. The third corner 77*c* is generally on the longitudinal axis of belt 10 and the second corner 77*b* is below the horizontal axis of the belt 10. The first corner 77*a* will be above the second corner 77*b*, the fourth corner 77*d* will be above the third corner 77*c* with the third corner 77*c* located above the first corner 77*a*.

The holster 70 has predetermined dimensions with the holster entrance portion 74*a* having a length of ⅓ of the length of the holster panel 72 as measured along the longitudinal axis 78 of the holster panel 72 from the entrance edge 76*a* to the exit edge 76*d*. The holster taper portion 74*b* is generally ⅓ of the length of the holster panel 72 and the holster exit portion 74*c* is the remaining ⅓ of the length of the holster panel 72. The entrance edge 76*a* and the exit edge 76*d* are generally parallel with each other and perpendicular to the holster panel longitudinal axis 78. The entrance edge 76*a* may be located a distance of 8.89-17.78 cm (3.5-7 inches), preferably 10.16 cm (4 inches) from the exit edge 76*d* as measured along the holster panel longitudinal axis. The entrance portion 74*a* may have a width between 50.8-101.6 mm (2-4 inches), preferably 63.5 mm (2.5 inches) and sized to prevent a trauma shear's thumb and finger grips from sliding into the entrance holster's entrance portion 74*a*. The width of the holster exit portion 74*c* may be being between 1.91-3.81 cm (0.75-1.5 inches), preferably 3.175 cm (1.25 inch). The holster panel 72 is constructed of the same material and preferably having the same material thickness as the outer layer 14 of the belt 10. The entrance edge 76*a* and the exit edge 76*d* have a single layer piping, such as the single layer piping 33*d* as shown FIG. 2*d*. The holster 70 may have an antimicrobial capability and is preferably made of the same material as the outer layer 14 of the belt 10.

Figure 8A:
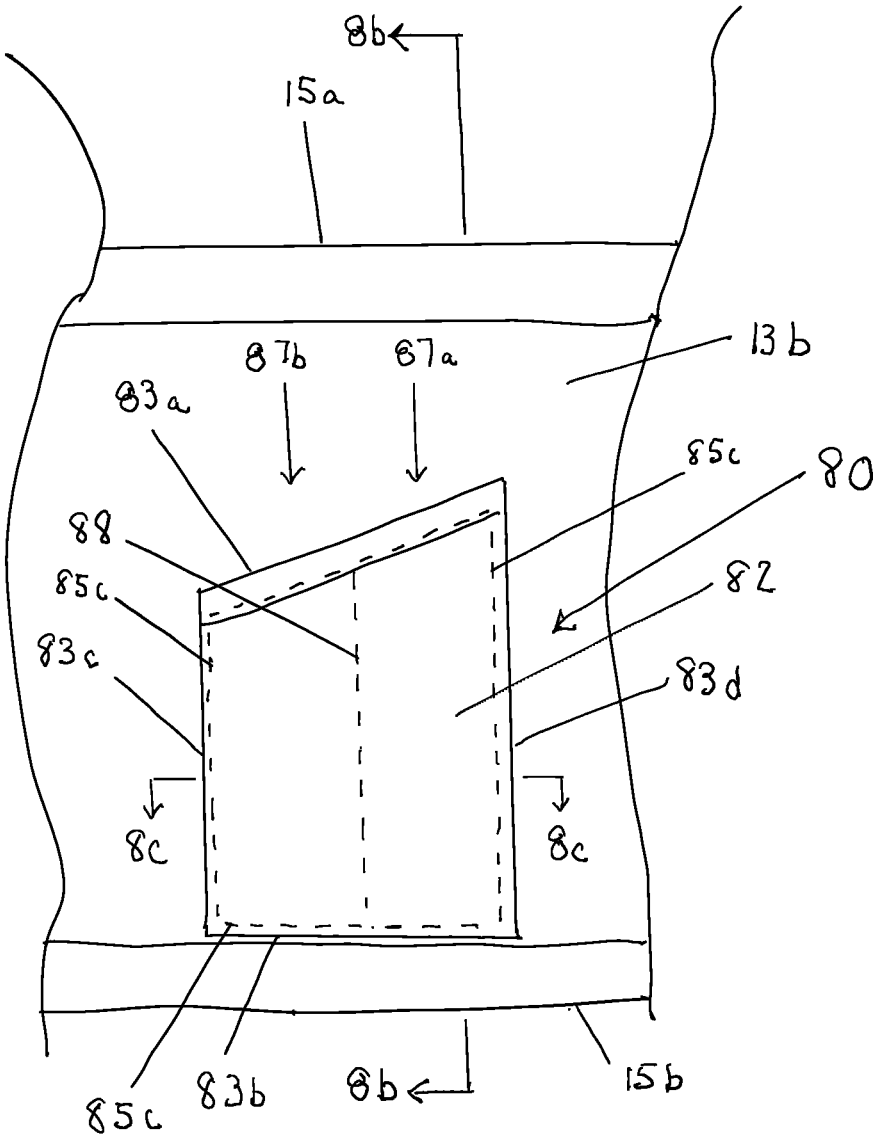
FIG. 8*a* is a frontal view of a pen holder
Figure 8B:
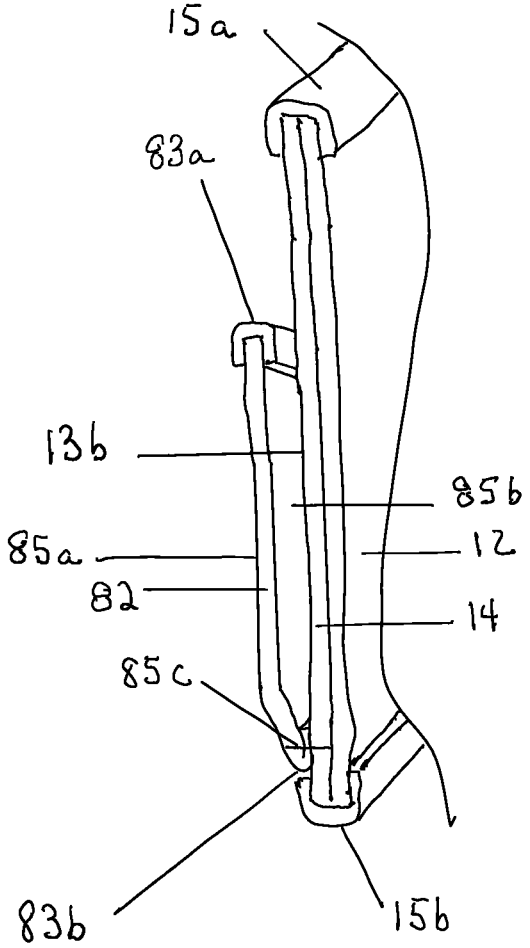
FIG. 8*b* is a cross sectional view taken along line 8*b*-8*b* of FIG. 8*a*
Figure 8C:
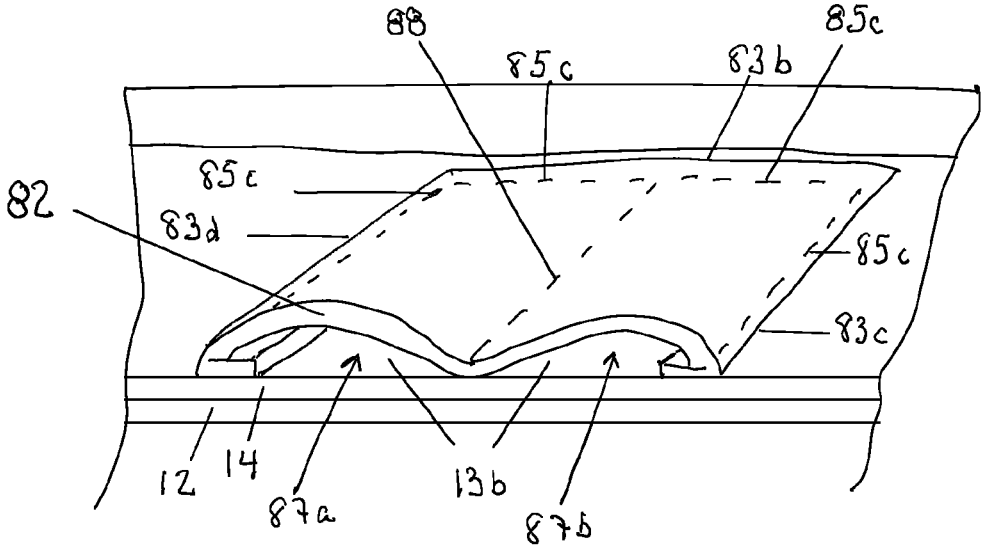
FIG. 8*c* is a cross sectional view taken along line 8*c*-8*c* of FIG. 8*a*

Looking at FIGS. 1 and 3*a*, and more specifically at FIGS. 8*a*, and 8*b*, the pen holder 80 has a trapezoidal pen panel 82 with a pen panel top edge 83*a*, a pen panel bottom edge 83*b*, a pen panel first side edge 83*c* generally parallel to a pen panel second side edge 83*d*, a pen panel outer surface 85*a*, and a pen panel inner surface 85*b*. The trapezoidal pen panel 82 is mounted to the exposed surface 13*b* of the outer layer 14 of the belt 10 so that the pen panel outer surface 85*a* is exposed and pen panel inner surface 85*b* is facing to exposed surface 13*b* of the outer layer 14 of the belt 10. Looking again at FIG. 8*a*, a pen panel perimeter row of stitches 85*c* located generally 3.175 mm (⅛ inches) inside of the first side edge 83*c*, the bottom edge 83*b* and the second side edge 83*d*, and penetrating the pen panel 82 and the outer layer 14 of the belt 10 secures the pen panel 82 to the exposed surface 13*b* of the outer layer 14 of the belt 10. Looking at FIGS. 8*a* and 8*c*, the pen holder 80 contains a plurality of receptacles, preferably 2 receptacles, such as a first receptacle 87*a* and a second receptacle 87*b*. The trapezoidal pen panel 82 gives the first receptacle 87*a* and the second receptacle 87*b* a varying depth as measured from the pen panel top edge 83*a* to the pen panel bottom edge 83*b* as one proceeds across the pen panel top edge 83*a* allowing the first receptacle 87*a* and the second receptacle 87*b* to accommodate pens of varying lengths, such as the first pen 81*a* and the second pen 81*b* shown in FIG. 1. Looking at FIGS. 8*a*, 8*b* and 8*c*, the receptacles, such as the first receptacle 87*a* and the second receptacle 87*b*, are formed between the pen panel inner surface 85*b* and the exposed surface 13*b* of the outer layer 14 of the belt 10 by a pen panel inner row of stitches 88 running from the top edge 83*a* to the bottom edge 83*b*. The inner row of stitches 88 are generally parallel with the first side edge 83*c* and a distance from the first side edge 83*c* as measured by dividing the width of the pen panel 82 as measured from the first side edge 83*c* to the second side edge 83*d* by the total number of receptacles. The pen panel 82 has a width of 2.54-10.16 cm (1-4 inches), preferably 6.35 cm (2.5 inches), and a length of the first side edge 83*c* being 7.62-12.7 cm (3-5 inches), preferably 10.16 cm (4 inches) and the length of the second side edge 83*d* being 10.16-15.24 cm (4-6 inches) preferably 12.7 cm (5 inches). The pen holder 80 may have an antimicrobial capability and is preferably made of the same materials as the outer layer 14 of the belt 10.

Figure 9A:
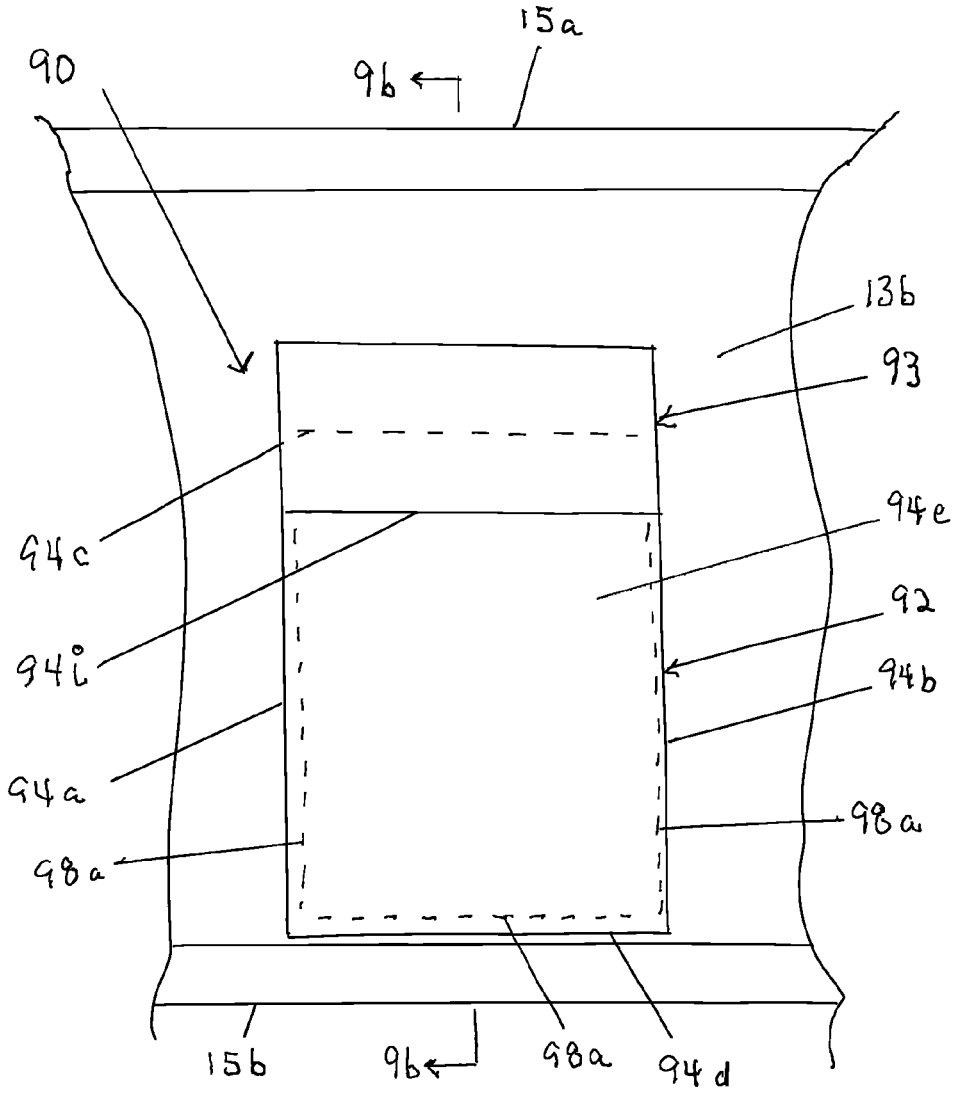
FIG. 9*a* is a frontal view of a communications compartment
Figure 9B:
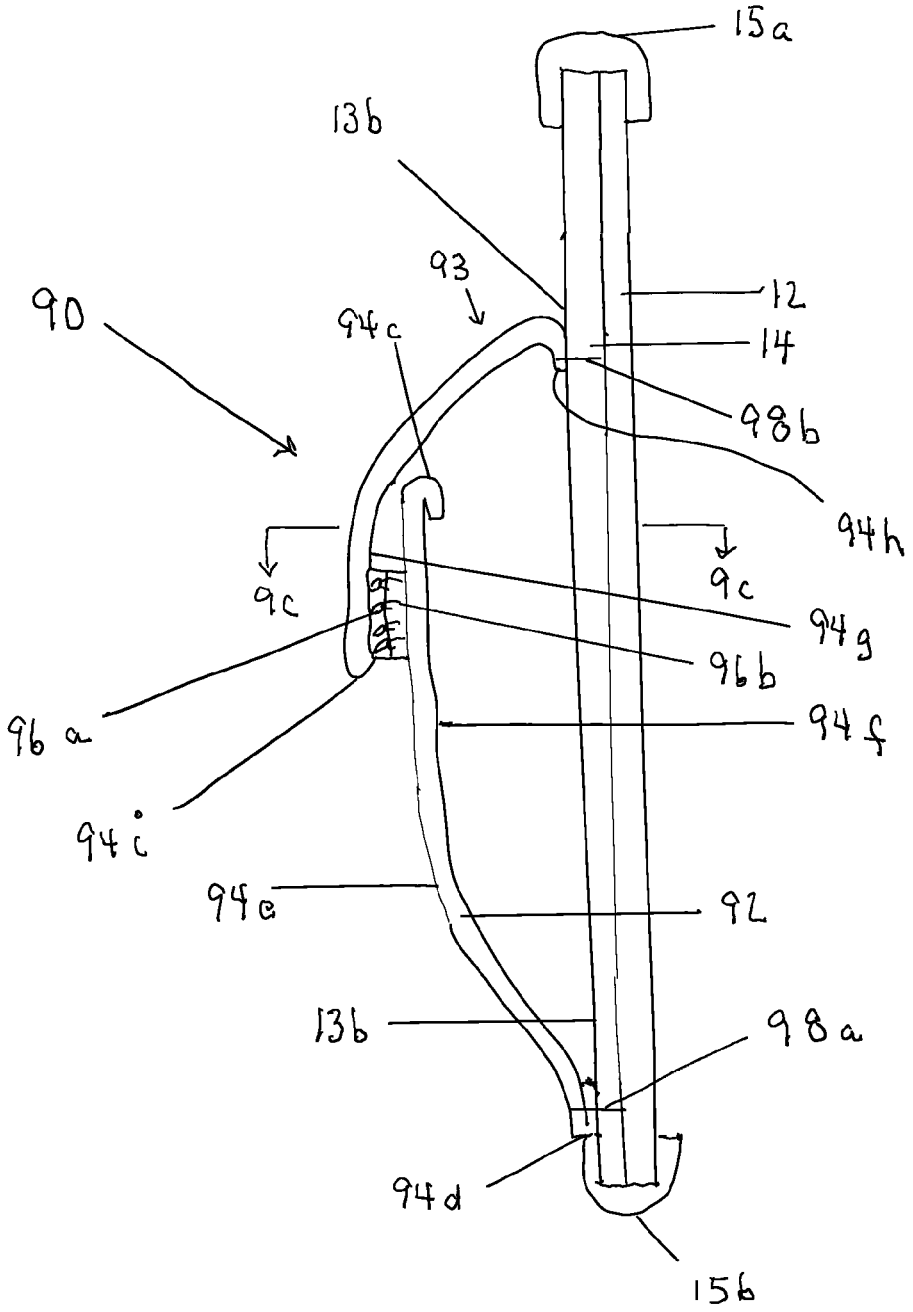
FIG. 9*b* is a cross sectional view taken along line 9*b*-9*b* of FIG. 9*a*
Figure 9C:
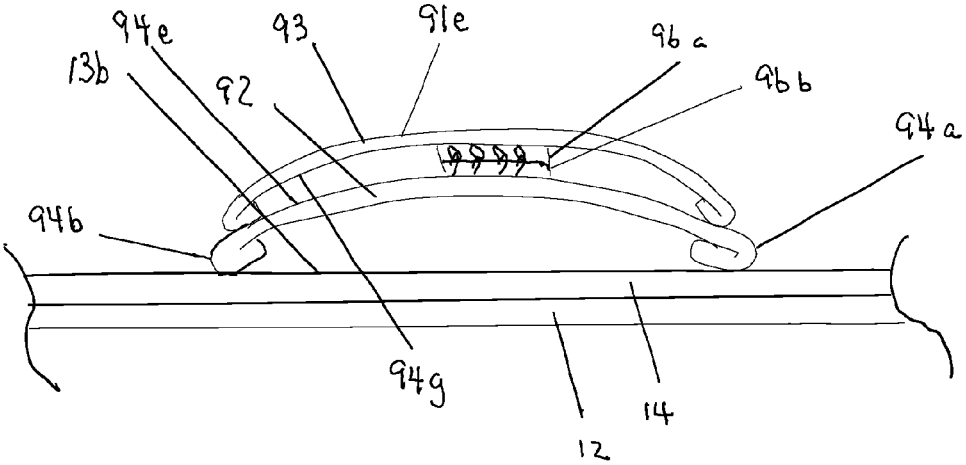
FIG. 9*c* is a cross sectional view taken along line 9*c*-9*c* of FIG. 9*b*

Referring to FIG. 1, FIG. 3*a*, and more specifically FIG. 9*a*, the communications compartment 90 is comprised of a generally elongated rectangular compartment panel 92 and with a generally rectangular flap panel 93. Looking at FIGS. 9*a* and 9*b*, the compartment panel 92 has a first side edge 94*a*, a second side edge 94*b*, an opening edge 94*c*, a bottom edge 94*d*, an outer surface 94*e*, and an inner surface 94*f*. The flap panel 93 has a flap inside surface 94*g*, a flap secure edge 94*h* running generally parallel to the longitudinal axis of the belt 10, and a flap free edge 94*i* running generally parallel to the longitudinal axis of the belt 10. The compartment panel 92 is positioned on the exposed surface 13*b* of the outer layer 14 of the belt 10 so that the first side edge 94*a* and the second side edge 94*b* are generally perpendicular to the longitudinal axis of belt 10. The compartment panel 92 is attached to the belt 10 by a compartment panel first row of stitches 98*a* running along the first side edge 94*a*, the bottom edge 94*d*, and the second side edge 94*b* with the compartment panel first row of stitches 98*a* penetrating the outer layer 14 of the belt 10. The flap panel 93 is positioned on the exposed surface 13*b* of the outer layer 14 of the belt 10 so that the flap free edge 94*i* and the flap secure edge 94*h* are generally parallel to the longitudinal axis of belt 10 with the flap secure edge 94*h* located generally at 12.7-50.8 mm (0.5-2 inches), preferably 25.4 mm (1 inch) above the opening edge 94*c* of the compartment panel 92, and with the flap panel 93 attached to outer layer 14 of the belt 10 by a flap panel row of stitches 98*b* along secure edge 94*h*. Looking at FIGS. 9*b* and 9*c*, the flap panel 93 may be folded down over the opening edge 94*c* securing any contents inside of the communication compartment 90 by a compartment first fastener 96*a* attached to the inside surface 94*g* of the flap panel 93 near the flap free edge 94*i* that is capable of being fastened to a compartment second fastener 96*b* mounted on the outside surface 94*e* of the compartment panel 92. The first fasteners 96*a* and the second fastener 96*b* may be a loop and hook fastener, a buckle fastener, or a snap fastener, preferably a loop and hook fastener. The compartment panel 92 and the flap panel 93 have predetermined dimensions and may be made of the same materials as the outer layer 14 of the belt 10 and may have an antimicrobial capability. The compartment panel 92 and the flap panel 93 generally may have a thickness being 1.59-4.76 mm (1/16-3/16 inches), preferably 3.175 mm (⅛ inches); the compartment panel 92 has a length as measured along the first side edge 94*a* from the opening edge 94*c* to the bottom edge 94*d* of 101.6-203.2 mm (4-8 inches), preferably 127 mm (5 inches), and a width as measured from the first side edge 94*a* to the second side edge 94*b* on a line parallel to the longitudinal axis of belt 10 of 50.8-101.6 mm (2-4 inches), preferably 76.2 mm (3 inches). The flap panel 93 is sized allow the flap to extend 25.4-76.2 mm (1-3 inches), preferably 25.2 mm (1 inch), over outer surface 94*e* of the compartment panel 92 when the compartment 90 is in a closed position as shown in FIG. 9*b*.

Although the present invention has been described in considerable detail with reference to preferred versions thereof, other versions are possible. Therefore, the spirit and scope of the appended claims should not be limited to the description of the preferred versions contained herein. Various deviations and modification may be made within the spirit and scope of this invention without departing from the main theme thereof.

What is claimed is:

1. A trauma utility belt comprising: an elongated belt having an inner layer and an outer layer and an accessory layer and a stethoscope chest piece holder;

said inner layer and said outer layer having the same length and width; said inner layer located adjacent to said outer layer and fastened together by stitches resulting in an exposed surface of said inner layer, an exposed surface of said outer layer; said belt having a first end portion, a first tapper portion, a first hip portion, a second taper portion, a mid portion, a third taper portion, a second hip portion, a fourth taper portion, a second end portion, an upper edge, a lower edge, a first end fastener, a second end fastener, and a pad;

said upper and said lower edge being convex;

said first taper portion located between said first end portion and said first hip portion; said second taper portion located between first hip portion and the mid portion; said third taper portion located between said mid portion and said second hip portion; said fourth taper portion located between said second hip portion and said second end portion;

said belt having a longitudinal axis running from the first end portion to the second end portion symmetrically dividing the first end portion, the mid portion, and the second end portion;

said first and said second hip portions having constant and equal widths as measured transverse to the longitudinal axis from said upper edge to said lower edge;

said mid portion having a constant and equal width as measured transverse to the longitudinal axis from the upper edge to the lower edge;

said lower edge being parallel to and equidistant from the longitudinal axis along first taper portion, the second taper portion, the mid portion, the third taper portion, and the forth taper portion;

said mid portion, said first end portion and said second end portion widths being greater than the width of the first hip portion and the width of the second hip portion;

said mid portion having a length one quarter of the length of the belt as measured along the longitudinal axis;

said first end portion and said second end portions each having a length approximately one quarter of the length the length of the belt as measured along the longitudinal axis; said first, second, third and fourth taper portions each having a length approximately 1/24 the length of the belt as measured along the longitudinal axis; said first and second hip portions each having a length approximately 1/24 the length of said belt as measured along the longitudinal axis;

said first taper portion upper edge tapering from the constant width of the first end portion to the narrower first hip portion;

said second taper portion upper edge tapering from the narrower first hip portion to the wider mid portion;

said third taper portion upper edge tapering from the wider mid portion to the narrower second hip portion;

said fourth taper portion tapering from the narrower second hip portion to the wider second end portion;

said pad positioned between said inner layer and said outer layer of said mid portion; said pad sized to provide lumbar and lower back support when the belt is tightened around the lower abdomen of a person;

said pad preferably made of high density foam;

said pad held in position between said inner and said outer layers by a pad row of stitches around the perimeter of said pad connecting the inner and outer layers of the belt;

said pad located so any portion of the pad closest to the lower edge of the belt is generally 1.5 inches from the lower edge;

said first end fastener mounted to said exposed surface of the inner layer of said first end portion;

said second end fastener mounted to the exposed surface of said outer layer of said second end portion;

said first end fastener capable of being operably fastened to said second end fastener when the belt is tightened around a person's lower abdomen;

said first end fastener and said second end fastener extending from the upper edge to the lower edge providing constant tension along the lower edge when the belt is tightened around a person's lower abdomen;

said inner layer, said outer layer, and said accessory layer made of an elastic material, preferably neoprene with an antimicrobial capability;

said chest piece holder further comprising a disk, a first clip, and a second clip;

said disk having an outer surface on which the first clip and the second clip are mounted;

said first clip and said second clip being generally identical;

said first clip and said second clip being generally cylindrical;

said first clip and said second clip mounted parallel to each other;

said first clip and said second clip having a predetermined clip configuration;

said predetermined clip configuration comprising a generally "L" shaped clip having a free end portion joined to a base portion at a 90 degree elbow;

said free end portion having a generally hemispherical free end tip;

said base portion mounted perpendicular to the disk outer surface;

said free end portion having an insert portion, a hold portion, a curved portion, and a parallel portion;

said insert portion located between the free end tip and the hold portion, and the insert portion angled away from the disk outer surface;

said curved portion located between the hold portion and the parallel portion;

said parallel portion being generally parallel to the disk outer surface and between the clip elbow and the curved portion;

said hold portion located between the curved portion and the insert portion, said curved portion curving downward toward the disk outer surface from the parallel portion to the hold portion;

said first clip and said second clip configured on said disk to hold a stethoscope chest piece having a bell, a diaphragm, and an ear tube stem by allowing the stethoscope chest piece to be inserted in the chest piece holder by first slipping the chest piece ear tube stem and then the chest piece bell between the free portion of the first clip and the free end portion of the second the clip, such that the chest piece bell is adjacent to the free end portion of the first clip and free end portion of the second clip, and the chest piece held by the hold portion of the first clip and the hold portion of the second clip so that the chest piece diaphragm is adjacent to the disk outer surface;

said disk attached to the belt by a disk rivet through the center of the disk attaching the disk to the exposed surface of the accessory layer of the belt, and allowing the disk, and consequently the chest piece holder to rotate around the disk rivet;

said disk, said first clip, said second clip, and said disk rivet having an antimicrobial capability.

2. The trauma utility belt of claim 1, further comprising: a retainer;

said retainer sized and configured for securing a stethoscope's ear tubes;

said retainer comprising a base, a first post and a second post;

said first post and said second post being generally identical "L" shaped cylindrical post said base having a base first side surface;

said first post having a first post short leg portion with a first post base end, a first post elbow portion, and a first post long leg portion with a first post hemispherical end; said first post elbow portion located between the first post short leg portion and the first post long leg portion;

said second posts having a second post short leg portion with a second post base end, a second post elbow portion, and a second post long leg portion with a second post hemispherical end;

said second post elbow portion located between the second post short leg portion and the second post long leg portion;

said first post and said second post mounted to the base;

said first post base end and said second post base end being adjacent to the first side surface of the base so that the first post short leg portion and the second port short leg portion are generally perpendicular to the base first side surface so that the first post long leg portion and the second post long leg portion are parallel to each other with the first post elbow portion located above the second post second post hemispherical end, and the first post long leg portion and the second post long leg portion running in a direction generally parallel to the longitudinal axis of the belt; said base symmetrically divided into a base first portion and a base second portion with the first post located in the base first portion above the second post located in the base second portion;

said retainer mounted on the exposed surface of the accessory layer of the belt with a base first rivet and a base second rivet;

said retainer sized and configured to allow a stethoscope's first ear tube and second ear tube to be inserted between the first post and the second post and then the first ear tube and the second ear tube rotated in a direction toward the first post hemispherical end and the second post hemispherical end until the first ear tube and second ear tube are between the first post hemispherical end and the first post short leg portion, and also between the second post hemispherical end and the second post short leg portion, and resulting in one ear tube coming to rest on the first post and the other ear tube coming to rest on the second post retaining the first ear tube and the second ear tube in the retainer;

said base, said first post, said second post, said base first rivet and said base second rivet having an antimicrobial capability.

3. The trauma utility belt of claim 1, further comprising: a personal items pouch;

said personal items pouch comprising a pouch zipper, a first panel, a transparent sheet, and a second panel;

said pouch zipper used to access and secure a pouch volume;

said pouch first panel having a rectangular cutout centered in the first panel;

said the rectangular cutout sized to view a standard identification card;

said transparent sheet cut to the shape of the rectangular cutout with said transparent sheet being somewhat larger than the rectangular cutout;

said transparent sheet placed between the rectangular cutout and the second panel;

said second panel located between the transparent sheet and the exposed surface of the outer layer of the belt;

said pouch volume formed between the second panel and the exposed surface of the outer layer of the belt;

said first panel having first panel first side edge, a first panel second side edge, a first panel bottom edge, and a first panel top edge;

said second panel having a second panel first side edge, a second panel second side edge, a second panel bottom edge, and a second panel top edge;

said second panel having a second panel first side edge, a second panel second side edge, a second panel bottom edge, and a second panel top edge;

said first panel first side edge, the first panel bottom edge, and the first panel second side aligned with the second panel first side edge, the second panel bottom edge, and the second panel second side edge, respectively; and secured to the outer layer of the belt by a first row of stitches through the first panel and the second panel around the second panel first side edge, the second panel bottom edge, and the second panel second side edge;

said pouch zipper running generally parallel to the longitudinal axis of the belt with the zipper located preferably below the second panel top edge and above the first panel top edge;

said transparent sheet centered on the rectangular cutout, and positioned adjacent to the first panel, and is secured to the first panel by a second row of stitches around the rectangular cutout, allowing said identification card to be inserted between the first transparent sheet the second panel;

said zipper attached to the second panel by a third row of stitches and a fourth row of stitches;

said first panel, said second panel and said transparent sheet having an antimicrobial capability;

said first panel, said second panel of the same material as the outer layer of the belt.

4. The trauma utility belt of claim 1, further comprising: a communications compartment; said communications compartment comprising a generally elongated rectangular compartment panel and a generally rectangular flap panel;

said compartment panel having a first side edge, a second side edge, an opening edge, a bottom edge, an outer surface, and an inner surface;

said flap panel having a flap panel inside surface, a flap secure edge, and a flap free edge; said compartment panel positioned on the exposed surface of the outer layer of the belt so that the first side edge and the second side edge are generally perpendicular to the longitudinal axis of belt;

said compartment panel attached to the belt by a compartment panel first row of stitches running along the first side edge, the bottom edge, and the second side edge with the compartment panel first row of stitches penetrating the outer layer of the belt;

said flap panel positioned on the exposed surface of the outer layer of the belt so that the flap free edge and the flap secure edge are generally parallel to the longitudinal axis of the belt;

said flap panel attached to the outer layer of the belt by a flap panel row of stitches along the secure edge;

said flap panel having a compartment first fastener attached to the inside surface of the flap panel near the flap free edge;

said compartment first fastener capable of being fastened to a compartment second fastener positioned on the outer surface of the compartment panel;

said compartment panel and said flap panel may be of the same material as the outer layer of the belt;

said compartment panel and said flap panel having an antimicrobial capability.

5. A trauma utility belt comprising: an elongated belt having an inner layer and an outer layer and an accessory layer, and a retainer;

said inner layer and said outer layer having the same length and width;

said inner layer located adjacent to said outer layer and fastened together by stitches resulting in an exposed surface of said inner layer, an exposed surface of said outer layer; said belt having a first end portion, a first tapper portion, a first hip portion, a second taper portion, a mid portion, a third taper portion, a second hip portion, a fourth taper portion, a second end portion, an upper edge, a lower edge, a first end fastener, a second end fastener, and a pad;

said upper and said lower edge being convex;

said first taper portion located between said first end portion and said first hip portion; said second taper portion located between first hip portion and the mid portion; said third taper portion located between said mid portion and said second hip portion; said fourth taper portion located between said second hip portion and said second end portion;

said belt having a longitudinal axis running from the first end portion to the second end portion symmetrically dividing the first end portion, the mid portion, and the second end portion;

said first and said second hip portions having constant and equal widths as measured transverse to the longitudinal axis from said upper edge to said lower edge; said mid portion having a constant and equal width as measured transverse to the longitudinal axis from the upper edge to the lower edge; said lower edge being parallel to and equidistant from the longitudinal axis along first taper portion, the second taper portion, the mid portion, the third taper portion, and the forth taper portion;

said mid portion, said first end portion and said second end portion widths being greater than the width of the first hip portion and the width of the second hip portion;

said mid portion having a length one quarter of the length of the belt as measured along the longitudinal axis;

said first end portion and said second end portions each having a length approximately one quarter of the length the length of the belt as measured along the longitudinal axis; said first, second, third and fourth taper portions each having a length approximately 1/24 the length of the belt as measured along the longitudinal axis; said first and second hip portions each having a length approximately 1/24 the length of said belt as measured along the longitudinal axis;

said first taper portion upper edge tapering from the constant width of the first end portion to the narrower first hip portion;

said second taper portion upper edge tapering from the narrower first hip portion to the wider mid portion;

said third taper portion upper edge tapering from the wider mid portion to the narrower second hip portion;

said fourth taper portion tapering from the narrower second hip portion to the wider second end portion;

said pad positioned between said inner layer and said outer layer of said mid portion; said pad sized to provide lumbar and lower back support when the belt is tightened around the lower abdomen of a person;

said pad preferably made of high density foam;

said pad held in position between said inner and said outer layers by a pad row of stitches around the perimeter of said pad connecting the inner and outer layers of the belt;

said pad located so any portion of the pad closest to the lower edge of the belt is generally 1.5 inches from the lower edge;

said first end fastener mounted to said exposed surface of the inner layer of said first end portion;

said second end fastener mounted to the exposed surface of said outer layer of said second end portion;

said first end fastener capable of being operably fastened to said second end fastener when the belt is tightened around a person's lower abdomen;

said first end fastener and said second end fastener extending from the upper edge to the lower edge providing constant tension along the lower edge when the belt is tightened around the person's lower abdomen;

said inner layer, said outer layer, and said accessory layer made of an elastic material, preferably neoprene with an antimicrobial capability;

said retainer sized and configured for securing a stethoscope's ear tubes;

said retainer comprising a base, a first post and a second post;

said first post and said second post being generally identical "L" shaped cylindrical post;

said base having a base first side surface;

said first post having a first post short leg portion with a first post base end, a first post elbow portion, and a first post long leg portion with a first post hemispherical end; said first post elbow portion located between the first post short leg portion and the first post long leg portion;

said second posts having a second post short leg portion with a second post base end, a second post elbow portion, and a second post long leg portion with a second post hemispherical end;

said second post elbow portion located between the second post short leg portion and the second post long leg portion;

said first post and said second post mounted to the base;

said first post base end and said second post base end being adjacent to the first side surface of the base so that the first post short leg portion and the second port short leg portion are generally perpendicular to the base first side surface so that the first post long leg portion and the second post long leg portion are parallel to each other with the first post elbow portion located above the second post second post hemispherical end, and the first post long leg portion and the second post long leg portion running in a direction generally parallel to the longitudinal axis of the belt; said base symmetrically divided into a base first portion and a base second portion with the first post located in the base first portion above the second post located in the base second portion;

said retainer mounted on the exposed surface of the accessory layer of the belt with a base first rivet and a base second rivet;

said retainer sized and configured to allow a stethoscope's first ear tube and second ear tube to be inserted between the first post and the second post and then the first ear tube and the second ear tube rotated in a direction toward the first post hemispherical end and the second post hemispherical end until the first ear tube and second ear tube are between the first post hemispherical end and the first post short leg portion, and also between the second post hemispherical end and the second post short leg portion, and resulting in one ear tube coming to rest on the first post and the other ear tube coming to rest on the second post retaining the first ear tube and the second ear tube in the retainer; and said base, said first post, said second post, said base first rivet and said base second rivet having an antimicrobial capability.

6. The trauma utility belt of claim 5, further comprising: a stethoscope chest piece holder;

said chest piece holder further comprising a disk, a first clip, and a second clip;

said disk having an outer surface on which the first clip and the second clip are mounted;

said first clip and said second clip being generally identical;

said first clip and said second clip being generally cylindrical;

said first clip and said second clip mounted parallel to each other;

said first clip and said second clip having a predetermined clip configuration;

said first clip and said second clip disposed and configured on said disk to hold a stethoscope chest piece having a bell, a diaphragm, and an ear tube stem by allowing the bell and the stem of the stethoscope chest piece to be inserted in the chest piece holder between said first clip and said second clip, with the diaphragm between the first clip and the outer surface, and the diaphragm between the second clip and the outer surface.

7. The trauma utility belt of claim 6 wherein said predetermined clip configuration comprises a generally "L" shaped clip having a free end portion joined to a base portion at a 90 degree elbow;

said free end portion having a generally hemispherical free end tip;

said base portion mounted perpendicular to the disk outer surface;

said free end portion having an insert portion, a hold portion, a curved portion, and a parallel portion;

said insert portion located between the free end tip and the hold portion, and the insert portion angled away from the disk outer surface;

said curved portion located between the hold portion and the parallel portion;

said parallel portion being generally parallel to the disk outer surface and between the clip elbow and the curved portion;

said hold portion located between the curved portion and the insert portion, said curved portion curving downward toward the disk outer surface from the parallel portion to the hold portion;

said first clip and said second clip configured on said disk to hold the stethoscope chest piece having the bell, the diaphragm, and the ear tube stem by allowing the stethoscope chest piece to be inserted in the chest piece holder by first slipping the chest piece ear tube stem and then the chest piece bell between the free portion of the first clip and the free end portion of the second the clip, such that the chest piece bell is adjacent to the free end portion of the first clip and free end portion of the second clip, and the chest piece held by the hold portion of the first clip and the hold portion of the second clip so that the chest piece diaphragm is adjacent to the disk outer surface;

said disk attached to the belt by a disk rivet through the center of the disk attaching the disk to the exposed surface of the accessory layer of the belt, and allowing the disk, and consequently the chest piece holder to rotate around the disk rivet; and said disk, said first clip, said second clip, and said disk rivet having an antimicrobial capability.

* * * * *